US009314098B2

(12) United States Patent
Sabounjian

(10) Patent No.: US 9,314,098 B2
(45) Date of Patent: Apr. 19, 2016

(54) SHELVING CONNECTOR

(71) Applicant: Pro-Mart Industries, Inc., Irvine, CA (US)

(72) Inventor: Azad Sabounjian, Irvine, CA (US)

(73) Assignee: Pro-Mart Industries, Inc., Irinve, CA (US)

( * ) Notice: Subject to any disclaimer, the term of this patent is extended or adjusted under 35 U.S.C. 154(b) by 0 days.

(21) Appl. No.: 14/687,142

(22) Filed: Apr. 15, 2015

(65) Prior Publication Data

US 2015/0289644 A1 Oct. 15, 2015

Related U.S. Application Data

(60) Provisional application No. 61/979,928, filed on Apr. 15, 2014, provisional application No. 62/015,991, filed on Jun. 23, 2014, provisional application No. 62/110,254, filed on Jan. 30, 2015.

(51) Int. Cl.
*A47B 57/54* (2006.01)
*A47B 57/34* (2006.01)
(Continued)

(52) U.S. Cl.
CPC ..... *A47B 57/545* (2013.01); *A47B 47/0083* (2013.01); *A47B 57/265* (2013.01); *A47B 57/34* (2013.01); *A47B 96/06* (2013.01)

(58) Field of Classification Search
CPC ..... A47F 5/103; A47F 5/101; A47F 5/01; A47B 96/068; A47B 47/0083; A47B 57/545; A47B 57/34; A47B 96/06; A47B 57/06; A47B 57/16; A47B 57/20; A47B 57/22; A47B 57/40; A47B 57/404; A47B 57/406; A47B 57/42; A47B 57/425; A47B 57/48; A47B 57/482; A47B 57/485; A47B 57/487; A47B 57/50; A47B 57/52; A47B 96/024; A47B 96/066; A47B 96/14; A47B 96/1408; A47B 96/1433; A47B 57/265
USPC ..... 211/187, 186, 208; 108/147.11–147.18, 108/107; 403/398, 386
See application file for complete search history.

(56) References Cited

U.S. PATENT DOCUMENTS 4,318,352 A * 3/1982 Friedman ..... A47B 57/265 108/107
4,656,952 A 4/1987 Schweizer
(Continued)

OTHER PUBLICATIONS

International Search Report of International Application No. PCT/US2015/026012, filed Apr. 15, 2015, in the name of Azad Sabounjian.

*Primary Examiner* — Daniel J Troy
*Assistant Examiner* — Hiwot Tefera
(74) *Attorney, Agent, or Firm* — Stetina Brunda Garred & Brucker; Lowell Anderson

(57) ABSTRACT

A sleeve for a shelving unit has two halves joined together to form two support tabs extending outward from opposing sides of the sleeve as the sleeve clamps around a post having grooves into which a rib on the sleeve fits to hold the parts relative to the post. The support tabs have a retaining flange offset from the sleeve. A first collar part fastened to a shelf fits over half the sleeve and fits into that offset so that a slot in the first collar part fits over one of the support tabs to clamp them to the post and support the first collar part and shelf. The retaining flange keeps the collar part from moving off the support tab. A second collar part with a second slot may fit over the other support tabs to support a second shelf or to further clamp the sleeve to the post.

29 Claims, 19 Drawing Sheets

(51) Int. Cl.

| | |
|---|---|
| ***A47B 96/06*** | (2006.01) |
| ***A47B 57/26*** | (2006.01) |
| ***A47B 47/00*** | (2006.01) |

(56) References Cited

U.S. PATENT DOCUMENTS 6,044,988 A * 4/2000 Yang ..... A47B 57/265 108/107
6,068,143 A 5/2000 Wang
6,253,933 B1 7/2001 Yang
7,059,484 B1 * 6/2006 Goldberg ..... A47B 47/0083 211/153
7,478,971 B2 1/2009 Li
8,678,207 B2 * 3/2014 Shimazaki ..... A47B 57/545 108/147.13
8,887,647 B2 * 11/2014 Sabounjian ..... A47B 57/10 108/147.13
9,167,915 B1 * 10/2015 Lau ..... A47B 47/0083
2010/0108631 A1 * 5/2010 McAllister ..... A47B 57/545 211/187

* cited by examiner

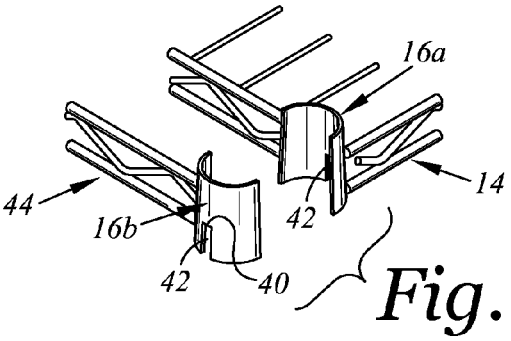
Fig. 5a
Fig. 5b
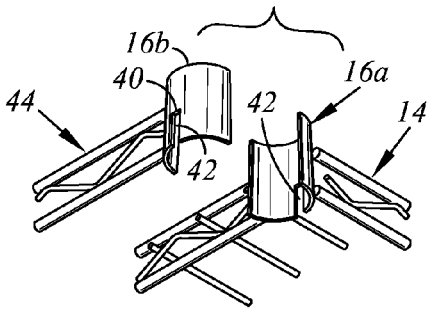
Fig. 5d
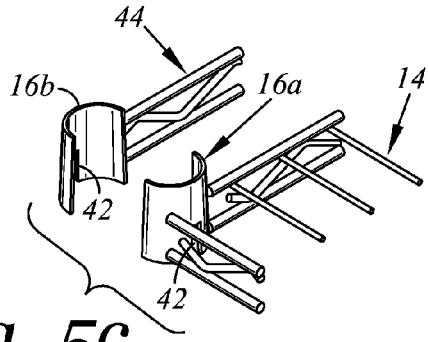
Fig. 5c
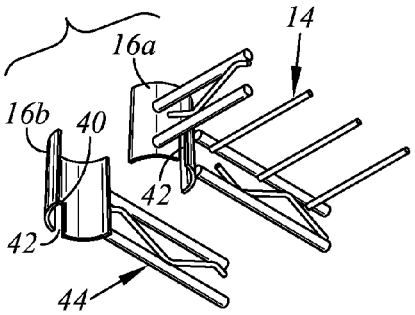
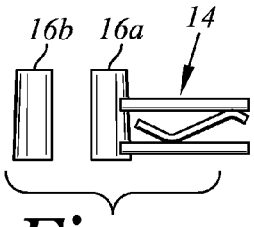
Fig. 5e

SHELVING CONNECTOR

CROSS-REFERENCE TO RELATED APPLICATIONS

The application claims the benefit under 35 U.S.C. §119(e) to Provisional Patent Application No. 61/979,928 filed Apr. 15, 2014 and Provisional Patent Application No. 62,015,991 filed Jun. 23, 2014 and Provisional Patent Application No. 62,110,254 filed Jan. 30, 2015, the entire contents of each of these applications are incorporated herein by reference.

BACKGROUND

The present invention relates generally to a support structure that can be used to support shelving or other elements for carrying or supporting any desired item. More particularly, the present invention relates to a support assembly for use in, for example, a knock-down shelving system to adjustably support shelves.

Current knock-down shelving systems include a plurality of support posts for supporting one or more shelves at corner support assemblies thereof. These shelving systems have a sleeve or wedge member and an encircling collar both adapted to be secured to a generally cylindrical support post having a circular cross-section. The sleeve has an inner surface that is configured to embrace the support post and has an outer surface that is wedge shaped usually taking the form of a frusto-conical shape with a narrower diameter at the top and a larger diameter at the bottom. The collar has an outer surface that is secured to a shelf. The collar has an internal wedge surface formed to mate with the frusto-conical wedge surface of the sleeve but either inclined in the opposing direction or having a smaller upper opening which does not allow passage of the sleeve on the post. Thus, when the sleeve embraces the post and the collar embraces the sleeve, axial loading of the collar in one direction causes the collar's inward facing wedge surface to mate with the outward facing wedge surface on the sleeve, thereby urging the sleeve toward the post. Since the collar is restrained from radial expansion and has a fixed diameter, and since relative movement of the inclined surfaces of the sleeve and the collar want to increase in diameter as they move relative to one another in axially opposing directions, the non-expandable outer collar forces the sleeve inward and clamps the sleeve against the post and wedges the collar and sleeve into place on the post.

Such shelving systems are disclosed in U.S. Pat. Nos. 3,424,111 and 3,523,508, which use a plurality of cylindrical support posts each formed with a series of equally spaced, annular grooves on its outer surface. A basic shelving system includes four such posts to support one or more formed-wire shelves, with each shelf having a frusto-conically-shaped collar at each corner for receiving a support post. A two-piece interlocking sleeve fits around the support post. The sleeve has a circumferential rib on its interior surface for engaging one of the grooves on the support post and has a frusto-conically-shaped outer surface, which is widest at the bottom, designed to complement the shape of the shelf collars. The support posts fitted with sleeves are received in the collars of each shelf to assemble the shelving system. When assembled, the weight of the shelf and any items placed on the shelf pushes downward on the collar and sleeve, creating a radially-inwardly directed wedging force between the collars and sleeves, which brings the sleeves into tight contact with the posts. Similar wedging concepts are used in U.S. Pat. Nos. 4,811,670; 4,946,350; 5,271,337; 5,279,231 and 6,113,042. Some of these devices use over-center cams to ensure the collars are locked in place.

Further, the above described collars have a fixed diameter and thus pass along the length of the post until they reach the sleeve with which they wedge against the post. That requires assembling the shelving from the bottom up or the top down since the collars cannot be positioned between two previously installed shelves. Further, a shelf cannot be inserted between pre-installed shelves since the collars cannot slide over previously installed sleeves or collars. Because the collars in these prior art connectors were tubular they had to be slid axially over one end of the post in order to mate with the sleeve and wedge the parts in place. To address this difficulty collars which encircles less than a full 360 degrees were developed, with some collars having open vertical slots like U.S. Pat. Nos. 6,302,284 and 6,257,426, and other collars mating with sleeves or other parts along generally vertical axes, as described in U.S. Pat. Nos. 6,068,143 and 4,656,952. But the open slotted collars provide a weak connection because sufficient weight on the shelf and collar will spread the unconnected parts of the collar apart in the circumferential direction, releasing the support. The collars mating with shaped sleeves required more expensive and stronger sleeves. The collars using vertical joints require precise alignment of the vertical joints making them difficult to align and assemble.

Still other connectors placed brackets on the outer, metal collars with the shelving rods engaging the brackets, as shown in U.S. Pat. Nos. 6,015,052 and 6,253,687. These collars required assembling the shelving from the bottom up since the collars cannot be positioned between two previously installed shelves. Further, a shelf cannot be inserted between pre-installed shelves since the collars cannot slide over previously installed sleeves or collars. Because the collars in these prior art connectors were tubular they had to be slid axially over one end of the post in order to mate with the sleeve and wedge the parts in place. There is thus a need for a connector that can allow shelves to be inserted between existing shelves.

Despite the long use of these above-described shelving systems, a need exists for an improved connector and shelving system, especially one easier to assemble and more flexible in its assembly. There is thus a need for an improved shelving connector that may be installed without having to slide the connector along the entire length of the post to the desired shelving position and that may be easily installed.

Further, during shipment or movement of disassembled shelving systems, parts may become lost. Likewise, confusion may arise in combining the correct parts for use. There is thus a need for a way to connect together parts that will be used together when the shelf assembly is being shipped, assembled or disassembled.

BRIEF SUMMARY

A sleeve for a shelving unit has two halves joined together to form two support tabs extending outward from opposing sides of the sleeve as the sleeve clamps around a post having grooves into which a rib on the sleeve fits to hold the parts relative to the post. The support tabs have a retaining flange offset from the sleeve. A first collar part fastened to a shelf fits over half the sleeve and fits into that offset so that a slot in the first collar part fits over one of the support tabs to clamp them to the post and support the first collar part and shelf. The retaining flange keeps the collar part from moving off the support tab. A second collar part with a second slot may fit over the other support tabs to support a second shelf or to further clamp the sleeve to the post. The support tabs may be hinged together by a recessed hinge that does not extend beyond the surface of the hinged parts and that does not interfere with the mating of the collar to the sleeve.

A compression lock is provided on a connector for a shelving post having a longitudinal axis. An inner sleeve has two interlocking parts, each of which is tapered to form a frusto-conical shaped sleeve when assembled. At least one rib extends inward from each part to fit into one of several corresponding grooves spaced at intervals along the length of the post. The sleeves each have at least one outward extending tab from which extends an axially aligned retaining flange such that the tabs offset their retaining flanges from the outward facing surface of the sleeve. There are preferably two tabs and retaining flanges on opposing sides, generally vertical sides of each sleeve so the tabs and retaining flanges of each sleeve abut and form two outward extending tabs and two retaining flanges on opposing sides of the sleeve. A tapered collar part connected to a corner of a shelf fits over at least part of the sleeve with the taper wedging the sleeve toward the post. The collar part has a slot opening onto the bottom periphery of the collar part with a closed interior end. The slot is sized and located to fit over one pair of the abutting tabs and the collar part containing that slot fits between the retaining flanges and the sleeve so the collar part and shelf rest upon the abutting pair of tabs engaged by the collar part, with the retaining flange keeping the collar part from moving away from the sleeve and post. Another shelving unit and collar part may be placed on the another pair of abutting tabs on the collar part, or a retaining flange may be placed on any free pair of abutting tabs in order to lock them together and keep them and the associated parts of the sleeve from splaying.

In more detail there is also provided a sleeve for use with a shelving connector having a collar part configured to encircle a portion of a post having an outer surface with grooves at regular intervals along a length of the post, the collar part connected to a shelf, the collar part having a frusto-conical inner surface configured to wedge the sleeve against the post during use in order to position the sleeve, collar part and shelf along a length of the post. The sleeve has first and second interlocking parts which when interlocked has several structural features, the first of which is an inner surface defining a central cylindrical passage extending along a longitudinal axis of the sleeve and configured to conform to and abut the outer surface of the post, with the inner surface having at least one inwardly extending rib configured to mate with a groove in the post. The sleeve also has an outer surface with a generally frusto-conical shape, and it further has first and second outwardly extending support tabs each extending outward from a different one of two opposing sides of the sleeve with first and second retaining flanges extending from the respective first and second support tabs and extending along but offset from the outer surface of the sleeve. The offset is sufficient to allow a portion of the collar part to fit snugly between the first or second retaining flange and abut the support tab associated therewith. Additionally, the second interlocking parts of the sleeve each have an opposing top and bottom separated by a distance extending along the longitudinal axis and joined by a curved wall having opposing first and second sides extending between the top and bottom. Finally, the sleeve has a locking tab extending from one of the first and second sides and a recess formed in the other of the first and second sides with the recess configured to receive the locking tab.

In further variations, each of the first and second interlocking sleeve parts has a first and second support tab extending outward from a different side of the sleeve part and with first and second retaining flanges extending from respective first and second support tabs along a direction parallel to the longitudinal axis. Each of the two opposing sides of each sleeve may be straight and generally aligned with the longitudinal axis. The extending support tabs preferably, but optionally, extend radially outward from a bottom portion of the sleeve and further comprising a lip extending between the bottom portion of the sleeve encircling a portion of the circumferential bottom of the sleeve and preferably encircling the entirety of the outer periphery of the sleeve's bottom, extending between and joining the sleeve to the bottom of the retaining flange. Preferably, a lower end of the locking tab is adjacent the upper end of the support tab.

There is further provided a connector assembly for use with a post having a cylindrical cross-section of diameter D and a plurality of grooves at predetermined intervals and a wedging sleeve and collar part to position shelves along a longitudinal axis of the post, the connector. The assembly includes a sleeve having a frusto-conical outer surface with a first, small sleeve end and a second, larger sleeve end with both ends encircling the longitudinal axis during use. The sleeve has a cylindrical interior passage sized to fit around the post during use with at least one inwardly extending rib configured to fit within one of the grooves of the post during use. The sleeve is formed of first and second interlocking sleeve halves each having a smaller top and a larger bottom joined by two opposing sides each sleeve half includes a locking tab and a support tab. The locking tab extends from one side of the sleeve with and a recess in formed the other side of the sleeve which recess is configured to receive the locking tab from the other sleeve half. The locking tabs include first and second support tabs extending radially outward from each side of the sleeve, preferably at a bottom portion of the sleeve. Each support tab has a retaining flange extending therefrom along but offset from the adjacent outer surface of the sleeve half in the direction of the top of the sleeve half. The support tab is configured so that one support tab of each sleeve is located adjacent the corresponding support tab of the other sleeve when the locking tab engages the locking recess to form first and second pairs of support tabs. Each of the two interlocked sleeves forms half of a cylindrical passage that extends along the longitudinal axis and configured to abut the post during use. The assembly further includes a first collar part having an interior surface forming about half of a frusto-conical shape and sized to fit over and mate with the outer frusto-conical surface of the sleeve. The first collar part has a first slot therein located to fit over the first pair of adjacent support tabs and restrain them from moving circumferentially apart during use. A portion of the collar part adjacent the first slot is configured to fit into the offset between the retaining flange and the adjacent part of the sleeve as the first slot fits over the first pair of adjacent support tabs during use.

In further variations, the first slot in the first collar part and the first pair of adjacent support tabs are configured so the support tabs are urged toward each other. Each sleeve may have a lip extending between the bottom portions of each sleeve half and a bottom portion of the retaining flanges to join the sleeve to the bottom of the retaining flange. The assembly may also include a second collar part having an interior surface forming about half of a frusto-conical shape and sized to fit over and mate with the outer frusto-conical surface of the sleeve, with the second collar part having a second slot therein located to fit over the second pair of adjacent support tabs and restrain them from moving apart during use. A portion of the second collar part adjacent the second slot may be configured to fit into the offset between the retaining flange and the adjacent part of the sleeve as the second slot fits over the second pair of adjacent support tabs during use.

There is also disclosed a kit for a shelving unit having at least two, generally horizontal shelves connected to at least three generally vertical posts. The kit includes at least three posts each having a longitudinal axis and a cylindrical cross-section along the portion of a length of the posts at which the shelves are to be connected. Each post also has a plurality of grooves therein at predetermined locations which grooves are orthogonal to the longitudinal axis. The kit also has at least eight sleeves each having a cylindrical interior surface with at least one inwardly extending rib. The cylindrical surface is configured to abut the post and encircle the longitudinal axis during use with the rib configured and located to fit in one of the grooves in the post during use. Each sleeve has a frusto-conical exterior surface and has first and second support tabs extending radially outward from a bottom portion of opposing sides of each sleeve a short distance. Each first and second support tab has an upwardly extending retaining flange extending along an exterior surface of the sleeve and offset therefrom by the support tab from which the retaining flange extends.

The kit also includes at least two shelves with each shelf having at least three first-collar parts located around a periphery of the shelf and facing outward from the shelf. Each first-collar part has a frusto-conical interior surface smaller at the top and wider at the bottom and extending around an arc of about 180° along a first-collar part axis which coincides with the longitudinal axis during use, each first-collar part having a first slot therein extending parallel to the first-collar part axis. Each first slot has a closed end and two opposing sides opening onto a bottom of the first-collar part in which the first slot is located. Each first-collar part and its first slot are sized so the first-collar part fits between one of the retaining flanges and exterior surface of the sleeve while the sides of the first slot fit on opposing sides of one of the first support tabs from which the retaining flange extends. The first slot and first support tab are configured so that the first slot fits snuggly over the first support tab.

The kit also includes at least six second-collar parts. Each second-collar part may have a frusto-conical interior surface that is smaller at the top and wider at the bottom and extending around an arc of about 180° along the first-collar part axis which coincides with the longitudinal axis during use. Each second-collar part has a second slot therein with a closed end and two opposing sides opening onto a bottom of the second-collar part in which the second slot is located. The second slot extends parallel to the first-collar part axis during use. The first-collar part and second-collar parts interlock to define a generally cylindrical interior passage. Each second-collar part and its second slot are configured so the second-collar part fits between one of the retaining flanges and exterior surface of the sleeve from which the retaining flange extends, while the sides of the second slot fit on opposing sides of the second support tab from which the retaining flange extends. The second slot and second support tab are configured so that the second slot fits snuggly over the second support tab.

In further variations of the kit, each sleeve comprises a split sleeve having two sleeve halves with each sleeve half having a semi-circular top and semi-circular bottom joined by two opposing sides Each sleeve half may have a locking tab extending from one of its sides and a recess on the other of its sides which recess is configured to receive the locking tab of the other sleeve half to interlock the two sleeve halves together. Additionally, each sleeve may also optionally comprise a split sleeve having two sleeve halves each having a semi-circular top and semi-circular bottom joined by two opposing sides, with about half of a first support tab extending from one side of each sleeve half and about half of a second support tab extending from the other side of each sleeve half.

In still further variations of the kit, each of the plurality of the sleeve halves may further include a locking tab extending from one of its sleeve sides and a recess on the other of its sleeve sides which recess is configured to receive the locking tab of a different sleeve half to interlock the two sleeve halves together. Also, a lip may extend outward from a bottom edge of a plurality of the sleeves with the lip located to abut a first and second collar during use, including extending between the bottom of the sleeve and the bottom of the retaining flange.

The sleeves of the kit may have a plurality of the sleeves with sides that are straight and generally parallel to the longitudinal axis and wherein a plurality of the sleeves encircle about 180° of the longitudinal axis or less during use. Also, a plurality of the first and second support tabs may have a circumferential width W measured in a plane orthogonal to the longitudinal axis when the sleeves encircle that longitudinal axis, and the opposing sides of the first and second slots are spaced apart a corresponding width slightly smaller than W. More preferably, the circumferential width W increases from the closed end of the slot to the open end of the slot and the width of the first and second slots increases in a corresponding manner so the slots straddle the support tabs during use and wedge the support tabs together during use.

Advantageously the collar parts may be interlocked, with a shelf connected to one of the collar parts and the other collar parts used to interlock and inhibit removal of the collar parts from the post without disengaging the interlocking aspect of the collar parts. Thus, the first collar part may have a first slot to abut the support tab during use and the second collar part may have a second slot abutting the support tab during use, with the first and second slots extend in a first direction toward the end of the respective first and second slots. The interlocking may be achieved if the first collar part advantageously has two opposing distal ends and two first projections each extending along at least a portion of a different one of the distal ends. The first projections extend in the first direction. The first collar further has a first recess located inward of and adjacent to each first projection and further located on opposing sides of the slot and extending in a direction opposite the first direction. The second collar part has two opposing distal ends and two second projections each extending along at least a portion of a different one of the distal ends of the second collar part. The second projections extend in a direction opposite the first direction. The second collar part has a second recess located inward of and adjacent to each second projection and further located on opposing sides of the slot in the second collar part and extending in the first direction. During use the first projections fit within the second recesses and the second projections fit within the first recesses to interlock the first and second collar parts.

In a similar manner, the orientation of the parts may be reversed. Thus, the first collar part may have two opposing distal ends and two first projections each extending along at least a portion of a different one of the distal ends. In this configuration the first projections extend in a direction opposite the first direction (rather in in the first direction). The first collar has a first recess located inward of and adjacent to each first projection and further located on opposing sides of the slot and extending in the first direction (rather than opposite the first direction). The second collar part has two opposing distal ends and two second projections each extending along at least a portion of a different one of the distal ends of the second collar part, with the second projections extending in the first direction (instead of opposite the first direction). The second collar part has a second recess located inward of and adjacent to each second projection and further located on opposing sides of the slot in the second collar part and extending in a direction opposite the first direction (rather than extending in the first direction). During use the first projections fit within the second recesses and the second projections fit within the first recesses to interlock the first and second collar parts.

BRIEF DESCRIPTION OF THE DRAWINGS

These and other advantages and features of the invention will be better appreciated in view of the following drawings and descriptions in which like numbers refer to like parts throughout, and in which:

FIG. 5*a* is a top perspective view of the two collar parts of FIG. 1 looking toward the shelf;

FIG. 5*b* is a bottom perspective of the two collar parts of FIG. 5*a;*

FIG. 5*c* is a top perspective view of the two collar parts of FIG. 5*a* looking along the shelf;

FIG. 5*d* is a bottom perspective of the two collar parts of FIG. 5*c;*

FIG. 5*e* is a side view of the two collar parts of FIGS. 5*a*-5*d;*

DETAILED DESCRIPTION

Figure 1:
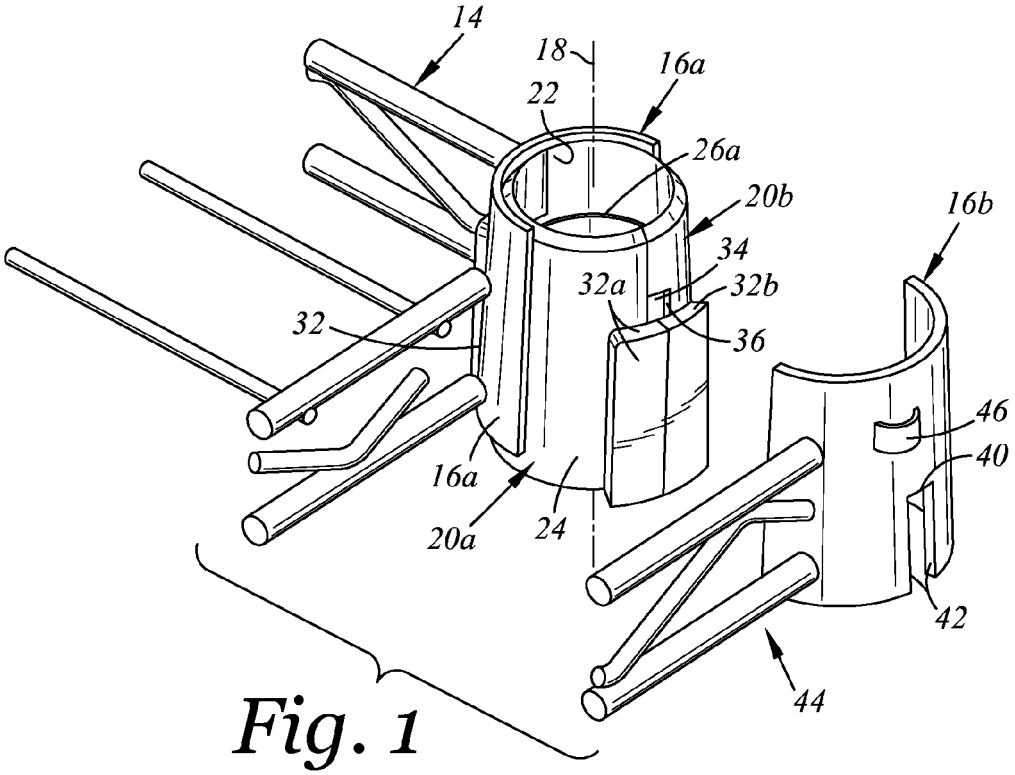
FIG. 1 is a partially exploded perspective view of a portion of a shelf fastened to a collar part and sleeve along with a portion of a locking end frame and collar part, looking along the shelf.
Figure 2:
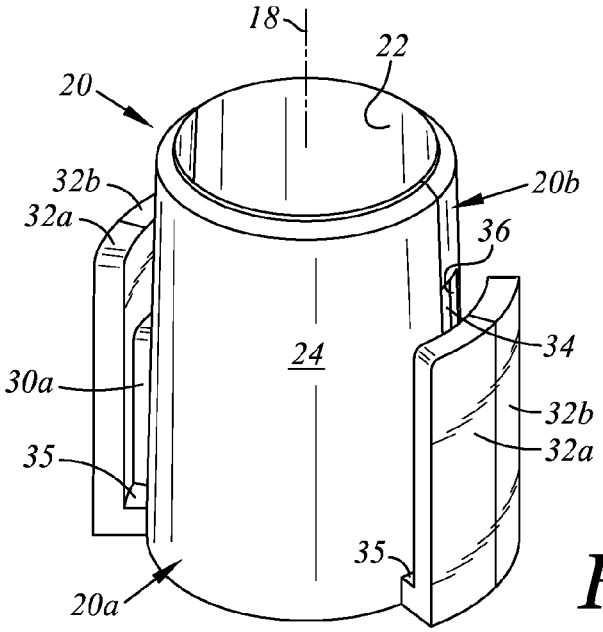
FIG. 2 is a perspective view of the sleeve of FIG. 1.
Figure 3A:
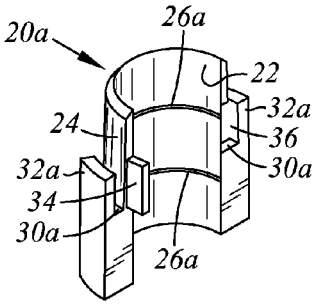
FIG. 3*a* is a top perspective view of a first sleeve half.
Figure 3B:
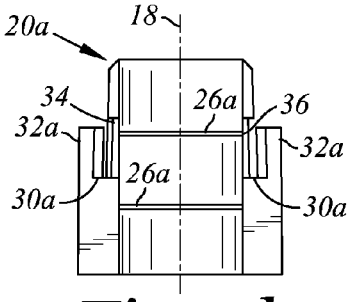
FIG. 3*b* is a front plan view of the first sleeve half of FIG. 3*a;*
Figure 3C:
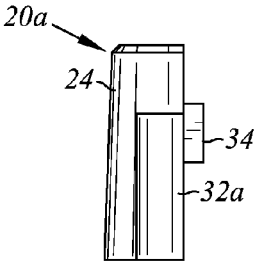
FIG. 3*c* is a left side view of the half sleeve of FIG. 3*b;*
Figure 3D:
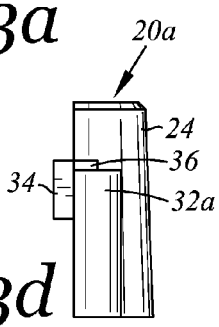
FIG. 3*d* is a right side view of the half sleeve of FIG. 3*b;*
Figure 3E:
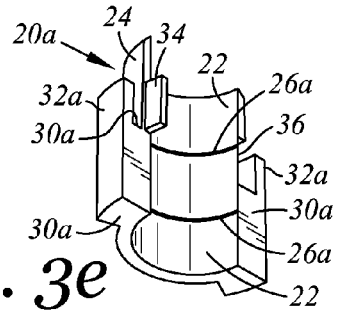
FIG. 3*e* is a bottom perspective view of the first half sleeve of FIGS. 3*a*-3*d;*
Figure 4A:
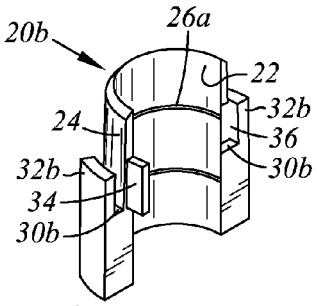
FIG. 4*a* is a top perspective view of a first sleeve half.
Figure 4B:
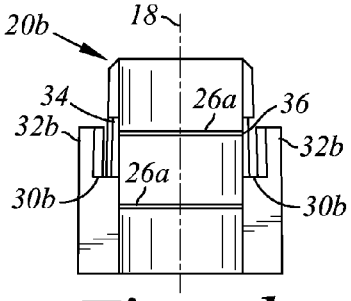
FIG. 4*b* is a front plan view of the first sleeve half of FIG. 3*a;*
Figure 4C:
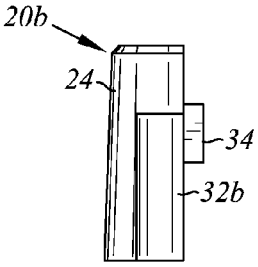
FIG. 4*c* is a left side view of the half sleeve of FIG. 3*b;*
Figure 4D:
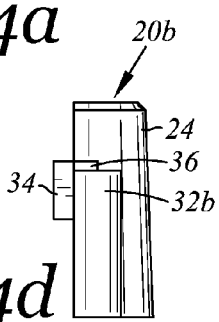
FIG. 4*d* is a right side view of the half sleeve of FIG. 3*b;*
Figure 4E:
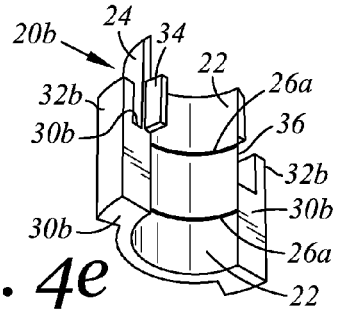
FIG. 4*e* is a bottom perspective view of the first half sleeve of FIGS. 3*a*-3*d;*
Figure 6A:
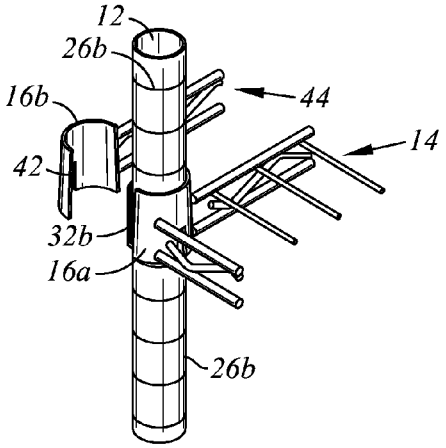
FIG. 6*a* is a top perspective view of part of a shelf fastened to a collar part that is fastened to a sleeve and post, and a partial end frame and collar part adjacent ready to be fastened to the sleeve and post, looking along a portion of the shelf.
Figure 6B:
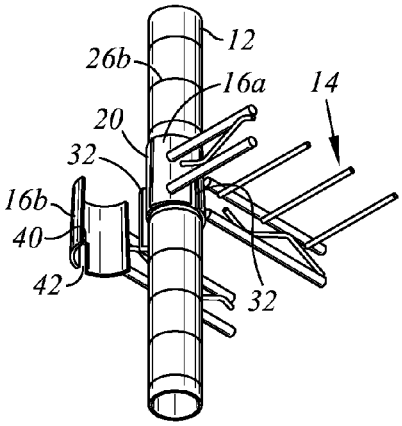
FIG. 6*b* is a lower perspective view of FIG. 6*a;*
Figure 6C:
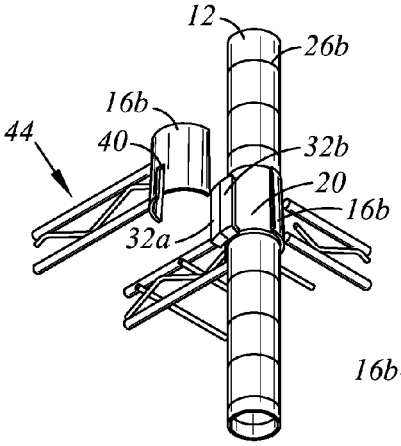
FIG. 6*c* is a bottom perspective view of FIG. 6*a* looking toward the shelf.
Figure 6E:
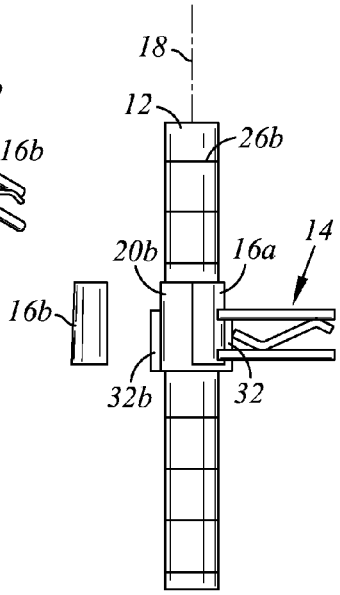
FIG. 6*e* is a side view of the assembly of FIG. 6*a;*
Figure 6D:
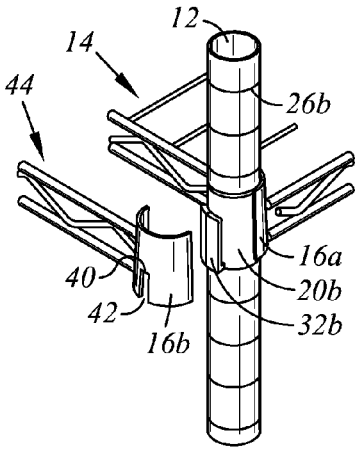
FIG. 6*d* is a top perspective view of FIG. 6*a* looking toward the shelf.
Figure 7A:
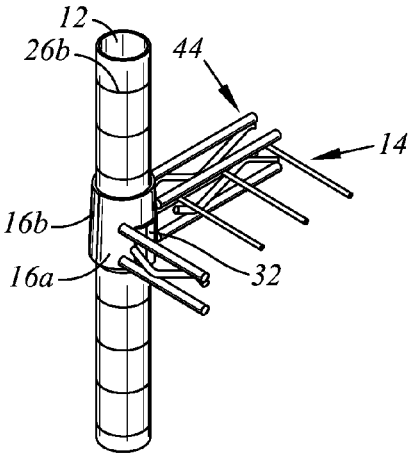
FIG. 7*a* is the a top perspective view of the assembly of FIG. 6*a* joined together.
Figure 7B:
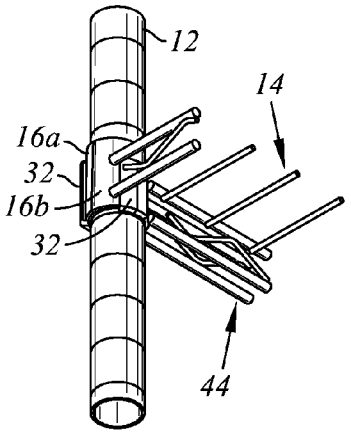
FIG. 7*b* is a lower perspective view of the assembly of FIG. 6*b* joined together.
Figure 7C:
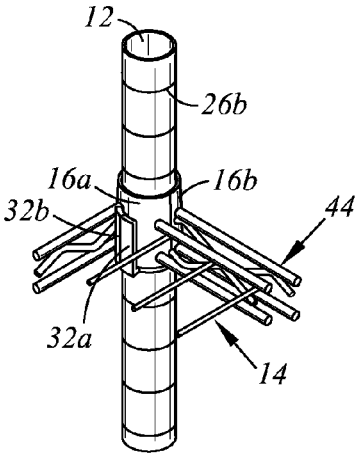
FIG. 7*c* is a top perspective view of FIG. 7*a* looking along the shelf.
Figure 7E:
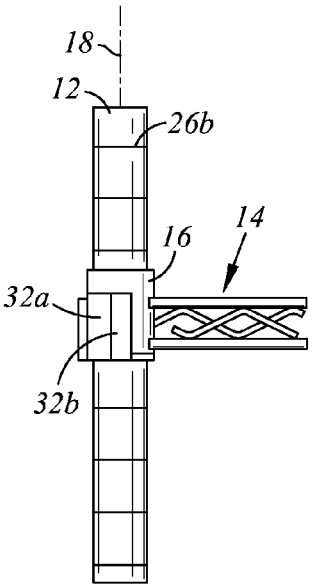
FIG. 7*e* is a side perspective view of the assembly of FIG. 6*e* joined together.
Figure 7D:
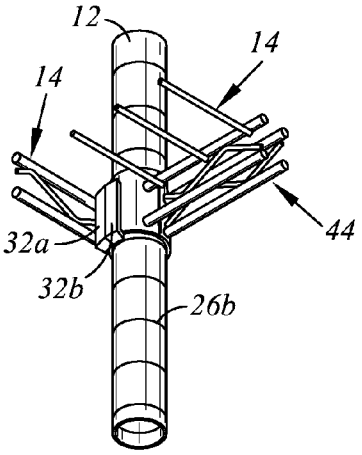
FIG. 7*d* is a bottom perspective view of FIG. 7*c;*

Referring to FIGS. 1-9, and especially to FIGS. 1-2, a connector of the present invention is described as used in a knock-down shelving system. The connector is preferably used in a shelving system that generally includes a plurality of support posts 12 which are preferably cylindrical, that is, that are generally circular in radial cross-section, but which could have other cross-sectional shapes. In the illustrated embodiment of FIGS. 9*a*, 9*b*, four such posts 12 are arranged to support one or more shelves 14 at corner assemblies thereof. The shelves 14 are typically wire frame shelves having corners connected to outer collar parts 16 of the connectors 10 to form shelving assemblies which are located at various elevations on the post 12 to form shelving assemblies. The shelves 14 are typically welded to collar parts 16 if the shelves and collars are of metal, but various connecting methods may be used. If the shelves and collars are of plastics, the parts may be integrals molded at the same time, or the collars 16 may be bonded to the shelf 14 by adhesives, ultrasonic bonding or other methods. The shelves 14 are preferably in a plane orthogonal to the longitudinal axis 18.

As used herein the relative terms above and below, upper and lower, top and bottom are with respect to the relative positions along the longitudinal axis 18 of a post 12, which is typically in the vertical direction. The relative terms inward and outward, inner and outer are the relative directions toward and away from that axis 18. These terms are provided with respect to the normal horizontal orientation of shelves and the vertical orientation of posts as shown in the attached figures. The orientation of the shelving unit may change and if so the orientation of the actual unit may be transposed to correspond with the orientation of the figures for easier and consistent understanding.

The collars 16 compress sleeves 20 inward toward posts 12 and are believed to wedge against the sleeves against the post to form a friction lock with the post. The collars 16 are usually split into two parts 16*a*, 16*b* but need not be so. If split into two parts the collar part 16*a* is on the shelving unit 14 while the collar part 16*b* is used to further lock the sleeves 20 and shelves in place. The sleeves 20 are formed of two, split sleeve halves 20*a*, 20*b* which are preferably axially symmetric images of each other as seen in FIGS. 3*a-d* and 4*a-d*. The sleeve halves 20*a*, 20*b* each have an interior surface 22 and opposing exterior surface 24. The interior surface 22 is sized and configured to conform to about half of the outer surface of post 12. In the preferred embodiment post 12 is cylindrical so inner surface 22 is about half of a cylindrical with a diameter about the same as or slightly larger than the outer diameter of post 12. Surface 22 encircles about half the post 12, and preferably slightly less than half. Outer surface 24 is slightly tapered like a cone, narrower in diameter at the top and larger in diameter at the bottom so that the outer surface of sleeve 20 is frusto-conical. A slight taper of about 1-5 degrees is believed suitable, with about 2-3 degrees taper being preferred.

The sleeve halves 20*a*, 20*b* each have two opposing, first and second sides shown in the figures as generally vertical sides. The arc subtended between each first and second side is slightly less than 180° so the sleeve halves may be squeezed toward each other by the collar parts 16*a*, 16*b* and squeezed tightly against the post 12 during use.

Each sleeve half 20*a*, 20*b* has an inwardly extending rib 26*a* sized and configured to mate with a corresponding groove 26*b* (FIGS. 6, 7, 9) in the outer surface of post 12. While one rib 26*a* is shown, more ribs can be used, but preferably few in number and most preferably 2 or 3 ribs. If the sleeve halves have more than one rib 26*a* the ribs are spaced apart along a length parallel to axis 18 at regular intervals which correspond to the distance between grooves 26*b* in the posts 12. The mating ribs 26*a* and grooves 26*b* are preferably semicircular in cross-section, but other cross-sectional shapes can be used.

Each sleeve half 20*a*, 20*b* has at least one support tab 30 extending outward from a bottom portion of the sleeve half and extending radially outward from each of the generally vertical sides, so there are first and second support tabs 30*a*, 30*b* on each sleeve half. The support tabs 30 preferably extend radially outward a distance D1 about 2-3 mm, but the distance will vary depending on the thickness of the collar part 16*a*, 16*b* as will become apparent later. The support tabs 30 preferably extend around a portion of the outer circumference of the sleeve a distance D2 of about 3 mm (about ⅛ inch), but that distance will vary with the load capacity to be carried, the materials and other factors as will become apparent later. In the depicted embodiment the support tabs 30 have a height H along axis 18 of about 20 mm (about ⅞ inch), but that distance will vary as described later. The support tabs 30 are preferably molded with the remainder of sleeve 30 and thus have a slight taper with the tabs 30 being larger at the bottom of the sleeve and smaller toward the top of the sleeve. At the bottom of the sleeve the width of each tab 30*a*, 30*b* is such that it subtends an arc of about 10°. As seen in FIGS. 2-4, the resulting sleeve halves 20*a*, 20*b* have a bottom portion that is much thicker at the location of the support tabs 30 and retention flange 32.

The outward ends of support tabs 30 extend upward to form a retaining flange 32. The retaining flanges preferably are curved and inclined to be generally parallel with the adjacent portion of the outer surface 24 of the sleeve 20. In the depicted embodiment each retaining flange 32 subtends an arc of about 25-30°. The support tabs 30 offset the retaining flanges 32 from the outer surface 24. In the depicted embodiment there is an increase in thickness of about 3 to 4 times the nominal wall thickness of the sleeve halves 20*a*, 20*b*. That increased thickness preferably extends from about ⅓ to about ½ the height of the sleeve halves 20*a*, 20*b* at the location of the support tabs 30. The retaining flanges 32 extend upward a distance of about ⅕ to ⅓ the height of the sleeve 20 measured along axis 18.

Referring to FIG. 2, each of the sleeve halves 20*a*, 20*b* may have a lip 33 extending along the bottom edge of each sleeve half 20*a*, 20*b*, preferably along a peripheral circumference corresponding to that of the retaining flange 32. The lip 33 advantageously extends around the entire periphery of the sleeve's bottom and more preferably extends between the inward facing surface of the retaining flange 32 and the facing surface of the sleeve 20. The collar 16 may rest against the lip 33 during use. Alternatively, the lip 33 may extend only between the retaining flange 32 and the adjacent surface of the sleeve 20, being further joined to the outwardly extending support tab 30*a* or 30*b*. Thus, the support tab 30 may have a larger, first axial length along the straight side of the sleeve and a much reduced axial length along lip 33 which extends from that straight side of the sleeve and curves around the periphery. The lip 33 thus connects the bottom of the sleeve to the bottom of the retaining flange 32 and support tab 30 and forms a hollow area behind the retention flange 32 within which the collar part 16*a*, 16*b* fits during use and against which the collar 16 may abut during use.

Referring to FIGS. 3*a*-3*e*, extending tangentially from the one side of sleeve half 20*a* is a locking tab 34. The locking tab 34 is shown as rectangular in cross-sectional shape with a bottom edge of the locking tab 34 adjacent the top surface of the support tab 30*a*. The locking tab 34 is thus at about the middle of one substantially straight side of the sleeve 20*a*, 20*b*. On the opposing substantially straight side of the sleeve 20 (sleeve parts 20*a*, 20*b*) is a locking recess 36 configured to receive the locking tab 34. The depicted locking recess 36 is thus rectangular in shape to receive the rectangular locking tab 34, and the locking recess 36 has a bottom adjacent the outwardly extending support tab 30*b*. The recess 36 is preferably a slot in the outer surface of the sleeve half 30*a* or 30*b* sized to receive the locking tab 34.

Referring to FIGS. 4*a*-4*e*, the other sleeve half 20*b* has a locking tab 34 and locking recess 36 on the opposite sides as does the sleeve half 20*a*. Because the mating sleeve half 20*b* is axially symmetric with sleeve half 20*a*, a detailed description is not provided of the common parts. When the sleeve halves 20*a*, 20*b* are put together the interior wall 22 of the sleeve defines a cylindrical passage to encircle and abut post 12 during use, and the two locking tabs 34 mate with the locking recesses 36 to hold the parts together.

The locking tabs 34 and mating locking recesses 36 are preferably configured to form a snap-fit or friction fit to releasably hold the sleeve halves 20*a*, 20*b* together. The locking tabs 34 may be tangential from the curve of sleeve 30, but preferably curves about axis 18 with the same curvature as either of the sleeves 30*a*, 30*b* and the recesses 36 may have abut walls with a conforming curve. The locking tabs and recesses 34, 36 prevent relative movement of the sleeve halves 20*a*, 20*b* along the direction of the longitudinal axis 18. In the depicted embodiment, the locking tabs 34 have a cross section about 2 mm thick by about 10 mm high and extend from the substantially straight side of the sleeve halves 20*a*, 20*b* a distance of about 4 mm. The locking recesses are preferably slightly deeper than the length of the locking tabs 34, with a depth of about 5 mm believed suitable when the locking tab 34 extends about 4 mm from the straight side of the sleeve.

Referring to FIGS. 1-2, when the two half sleeves 20*a*, 20*b* fit together the interior surface 22 defines an interior, cylindrical passage sized to encircle and abut against post 12, with the outer surface forming a frusto-conical surface with support tabs 30 and retaining flanges 32 on opposing sides of the sleeve 20. The support tabs 30*a*, 30*b* of each sleeve 20*a*, 20*b* abut each other along a substantially vertical plane containing the longitudinal axis 18. The interlocking locking tabs 34 and recesses 36 hold the sleeve halves together and restrain slippage along the generally vertical sides and axis 18. The abutting support tabs subtend a combined arc of about 10° at the bottom of the sleeves 30*a*, 30*b* and extend about 20 mm along axis 18, while the retaining flanges 32 subtend an arc of about 20° from axis 18, and extend from the bottom of sleeve 30 upward a distance of about 30 mm. These dimensions are for a post 12 having a diameter of about 25 mm, with sleeve 20 made of ABS, for a shelf having a load capacity of about 100 pounds.

Referring to FIGS. 1 and 6-8, the collar parts 16*a*, 16*b* are configured to mate with the sleeves 20 and squeeze them against the posts 12 as well as fitting into the offset space between the retaining flanges 32 and the sleeves, with the collar parts resting on the tabs 32. The collar parts 16*a*, 16*b* have a frusto-conical wall, or at least an inside that has a tapered, frusto-conical shape that is narrower in diameter at the top and wider at the bottom. The inclination of the frusto-conical wall is preferably about the same as that of the outer surface 24 of the sleeve 20, or slightly more. Each collar part 16*a*, 16*b* has substantially straight sides preferably extending along a plane containing longitudinal axis 18 edges. The opposing sides of each collar part 16 may subtend an arc of about 180° or slightly less.

Each collar part 16*a*, 16*b* has a slot with a closed end 40 and two parallel sides 42 extending to and opening toward the bottom of the collar part 16*a*, 16*b*. The slot is preferably at about the middle of the wall forming the collar part 16, about half way between the opposing, straight sides of the collar part. For the above described sleeve 20 the slot may have a width of about 5-6 mm and a height of about 8 mm, with the collar part having a height of about 40 mm and a thickness of about 2 mm when made of steel. The slot shape and size will vary as needed to conform to the shape of support tabs 30*a*, 30*b* as the purpose of the slot is to hold the tabs 30 together, preferably tightly together.

The width of the slot between the opposing sides 42 is preferably selected to correspond to the circumferential width W of the two abutting support tabs 30 measured in a plane orthogonal to the longitudinal axis 18, so that the sides 42 fit over and preferably very close to the sides of the support tabs 30. The sides 42 of the slot straddle the abutting pair of support tabs 30 with the end 40 of the slot resting on the top of the abutting pair of support tabs 30. The sides 42 are shown as straight, parallel and vertical as the abutting pair of support tabs 30 have straight, vertical sides. The sides 42 could be slightly tapered with the spacing narrower at the closed end 40 and further apart at the open end, preferably with the taper being about the same as that of the inclination angle of the frusto-conical wall of collar part 16*a*, 16*b*, in which case the abutting sides of the support tabs 30 preferably also have a matching inclination. Thus, if the width W of the abutting support tabs 30*a*, 30*b* increases from the top to the bottom of the support tabs, with the width W smaller at the top and larger at the bottom, then the sides 42 of the slot also increase in a corresponding manner. Advantageously, the increase in width may be slightly different to create a slight interference that resiliently urges the adjacent support tabs 30*a*, 30*b* toward each other and preferably so the tabs abut each other.

Likewise the shape of the end 40 of the slot preferably conforms to the shape formed by the top of the pair of support tabs 30 abutting that slot end 40. The wall forming the collar part 16*a*, 16*b* is sized so that it fits in the offset or gap between the retaining flange 32 and the exterior surface 24 of the sleeve 20 which offset is formed by support tab 30. The slot end 40 may thus rest against the top of the abutting support tabs 30*a*, 30*b* while the bottom of the collar part 16*a*, 16*b* adjacent the slot rest against the lip 33. The lip 33 is thus advantageously located relative to the dimensions of the support tabs 30 and collar part 16*a*, 16*b* and slot end 42 so that the bottom edge of the collar part adjoining sides 40 of the slot, abut or rest on the lip 33 during use. The collar part 16 advantageously rests continuously against lip 33 during use, but may abut the lip 33 only when the load on the collar part 16 is high.

The collar 16 may have a collar part 16*a* connected to a shelf 14 (FIG. 1), or a part 16*b* connected to a locking end frame 44 (FIG. 8) having a collar part 16 on each end but not connected directly to a shelf. Alternatively, referring to FIG. 1, the collar part 16*b* may have a manipulation tab 56 extending outward from the collar part 16*a*, 16*b* a distance sufficient to allow a user to push on the manipulation tab 46 to install the collar part, or to pull upward on the manipulation tab to release it from the mating sleeve 20. Also, each collar part 16*a*, 16*b* may be separate, without any connecting frame 44, so each collar 16 may be separately locked in position. In actual use a user may also strike the manipulation tab with a tool such as a hammer to install or tighten the collar part, or to loosen or unfasten the collar part. The manipulation tab 56 may take diverse forms and is shown as a portion of a tube with its axis aligned with axis 18, fastened to the outer surface of the collar part 16*b*. The manipulating tab 56 is advantageously configured so as not to have sharp edges or protrusions as would snag clothing or cut a person's hands.

In use, the two sleeve halves 20*a*, 20*b* may be snapped around a vertical post 20 with the locking tabs 34 mating with the locking recesses 30 to hold the parts together. The sleeve halves 20*a*, 20*b* are located along the length of post 12 so the rib or ribs 26*a* in the sleeve mate with a corresponding groove 26*b* in the post at the height or location to which it is desired to fasten the shelf 14. All corners of the shelf 14 are preferably at the same height in order to avoid twisting one or more connections. As needed, the sleeve 20 is rotated around the post 12 so each pair of abutting support tabs 30 extends along the direction of a shelf edge or side, pointing toward one of the other corner posts to which the shelf 14 will be attached. A shelf 14 with a collar part 16*a* is then mated with the sleeve 20 such that the slot in the collar part 16*a* is fit over one pair of abutting support tabs 30 until the bottom 40 of the slot rests on top of the abutting support tabs and the sides 42 of the slot straddle those abutting support tabs, with the body of the collar part surrounding the slot fitting between the retaining flange 32 and the adjacent portion of the outer surface 24 of the sleeve. The other corners of the shelf 14 are similarly attached to other posts 12. That connection leaves one free pair of abutting support tabs 30 extending outward from the sleeve. Another collar part 16*a* on a shelf 14 may be similarly attached to that free pair of abutting support tabs. Alternatively, an end frame 44 may be connected in a similar manner with the slot of each collar part 16 fit over the abutting pair of support tabs. As a further alternative, a single collar 16 completely encircling the post may be placed over the free pair of abutting end tabs 30.

The parts may be removed and the shelves taken off the posts 12 by reversing the order of above described steps. Thus, a user may pull upward on the collar part 16*a*, 16*b* using manipulating tab 46, or pull upward on the locking bar or end frame 44, or pull upward on a shelf 14 to disengage the slot in a collar part from the paired support tabs 30. Once all collar parts 16*a*, 16*b* are removed from a sleeve 20, the sleeve halves 20*a*, 20*b* may be pulled apart and removed from the post.

When a collar part 16*a*, 16*b* is mated with an abutting pair of support tabs 30 the opposing sides 42 of the slot keep the sleeve halves 30*a*, 30*b* from separating. A tight fit is preferred between the slot sides 42 and the adjacent and preferably abutting sides of the support tabs 30*a*, 30*b*. As the end 40 of the slot in the collar part abuts the top of the abutting pair of support tabs 30 the support tabs support the weight of shelf 14 and items placed thereon. As the tapered sides of the collar part 16*a*, 16*b* mate with the tapered sides of the sleeve 20, each collar part wedges against the sleeve 20 and urges the sleeve toward the post for a frictional grip, and urges the ribs 26*a* into mating grooves 26*b*. As the weight on the shelf 14 increases the gripping forces on the collar part 16*a*, 16*b* and sleeve 20 increase through the inclined surfaces of the collar part 16*a*, 16*b* and sleeve 20. But the abutting support tabs 30 reduce the wedging force the collar part 16*a*, 16*b* exerts on the sleeve 20. Thus, the compressive force the collar part exerts on the sleeve is not as large as in prior art designs. The frusto-conical shaped inner surface of collar parts 16*a*, 16*b* thus mate with the correspondingly shaped frusto-conical outer surface of sleeve 20 to urge the sleeve against the post 12 during use. The mating parts of the collar parts 16*a*, 16*b* and sleeve halves 20*a*, 20*b* advantageously have the same slope or a slight interference fit, with slopes of about 2-10 with 2-5 degrees being preferred suitable and interference fits formed by slopes of 1-3 degrees difference in slope and these fits are used herein to define the preferred mating of these parts. The retaining flange 32 helps prevent the collar part 16*a*, 16*b* from slipping off the support tabs 30 and helps prevent the collar part 16*a*, 16*b* from moving laterally in the general plane of the shelf, which is usually horizontal.

It is believed advantageous to have sides 42 of the slot in the collar part cooperate with the abutting sides of the pair of support tabs so that the collar part urges the abutting pair of support tabs 30*a*, 30*b* together. This may be achieved by having each sleeve half 30*a*, 30*b* extend slightly less than 180 degrees around the post 12 so that a slight gap is formed between the straight edges of the sleeve halves and between the adjacent support tabs 30*a*, 30*b* when the sleeve halves are snapped onto the post 12. The sides 42 of the slot in collar part 16*a*, 16*b* may then resiliently urge the support tabs 30*a*, 30*b* toward each other until they preferably (but optionally) abut thus resiliently urging the bottom portion of the sleeve 30 against the post 12. Preferably a rib 26*a* is located inward of the support tabs 30*a*, 30*b* and this circumferential tightening by the slot sides 42 urging the support tabs together ensures a tight connection between the sleeve 30 and post 12 at the circumferential location of the support tabs, and ensures a tight connection between the rib 26*a* and groove 26*b*.

Because the sleeves 30*a*, 30*b* may be snapped onto the post 12 at any suitable location and the collar need not pass along the length of the post in order to connect to the sleeve 30, the shelves 14 may be connected in any order to the posts 12. No bottom-up assembly is required. Shelves may be inserted between two adjacent shelves without removing the upper shelves. The ease of assembly is believed to be superior to prior art designs.

The collars 16 are preferably split collars having first and second parts 16*a*, 16*b* each of which do not extend more than 180° around the circumference of the posts 12 and preferably extend about 178-179.5° around the circumference of the post. But the collar parts 16 could extend further and enclose a majority of the circumference of the post 12 and sleeve 30, particularly for collar parts connected to shelves 14. If so, the other collar part 16 engaging the other pair of abutting support tabs 30 would have a correspondingly smaller circumferential size so as to avoid the sides of the collar parts 16*a*, 16*b* overlapping or otherwise preventing a tight clamp to the post 12. Smaller sized collar parts 16*b* are believed suitable for collar parts on the end frames 44 or single collars 16 not connected to a shelf or an end frame but used to lock the free pair of abutting support tabs 30 and keep them from splaying and tightening the connection to the post.

The use of a collar part encircling about 185°-270° of the circumference of the post 12 and sleeve 30 is believed possible, with the other locking collar part encircling the remaining portion of the 360° circumference. If the collar part 16*a*, 16*b* encircles much more than about 185°-190° of the circumference, then the collar part may no longer be flexible enough to allow opposing sides of the collar part to spread apart to fit around the post 12 from the side, and may require the collar part to be positioned by sliding it axially along the length of the post 12 and axis 18.

The connector 10 can be used in various other types of support systems, such as cabinets, closets, rolling carts, rolling racks and the like, with a shelving system being only one example. Moreover, the connector 10 can be used in conjunction with many shelf embodiments and is not limited to use with a corner of a shelf, or for that matter, a corner of any supported member.

The sleeves 20*a*, 20*b* may be made of a suitable plastic. ABS, polyethylene and polyurethane are believed suitable. The sleeves are preferably molded as a single piece of material to form an integrally molded part. The posts 12, collar parts 16*a*, 16*b* and shelves 14 are preferably made of metal, but one or more of them may be made of a sufficiently strong plastic material. Depending on the weight which each shelf 14 or shelving unit is designed to support, the dimensions of parts and material used will vary.

A simplified shelving unit would include four corner posts 12, at least one and preferably more shelves 14 with collar parts 16 at each location on the shelf (generally corners) where the shelf is to connect to the post 12. For a rectangular shelf 14 with four collar parts 16*a*, 16*b*, one at each corner to connect to four posts, two end frames 44 would be needed for each shelf, or four single collar parts 38 for each shelf. A shelving kit may be provided that preferably includes those parts and more preferably includes two, three, four, five or six shelves 14 with corresponding numbers of collar parts 16*a*, 16*b* on each shelf, and twice the number of end frame connectors 44 as there are shelves (or four times the number of single collar parts 16*a*, 16*b*), and four times the number of sleeves 20 as there are shelves.

A kit may include the above combination of parts and combinations thereof. Thus, a simple shelving kit may have two shelves 14, which if rectangular in shape have a collar part 16*a* at each corner of the shelf. The kit would further include eight sleeves 20 and eight collar parts 16*b* that are either separated, or with pairs of collar parts 16*b* joined to form end frames 44. Each additional rectangular shelf added to the kit would preferably include four collar parts 16*a*, four collar parts 16*b* and four sleeves 20. If two shelving units are joined horizontally together by having two shelves 14 with two collar parts 16*a* at one end fasten to the same two posts 12, then the number of end frames 44 may be reduced by half, as may the number of single piece collars that completely encircle the post, if such single piece collars are used instead of end frames 44 or individual collar parts 16*b*.

The offset provided by extending tabs 30*a*, 30*b* is sized to form a gap between the locking tab 34 and the adjacent outer surface 24 of the sleeve 20 in order to snugly receive the mating portion of collar part 16*a*, 16*b*. A very slight interference fit is believed acceptable but undesirable. On the other than, a loose fit is undesirable. Thus a clearance of less than about 1 mm is believed desirable. The offset will vary with the materials of which the parts and shelves are made, and the load to be carried on the shelves and posts. Likewise, the dimensions of the sleeves and parts thereof will vary with the materials and loads to be carried by the parts.

Figure 14:
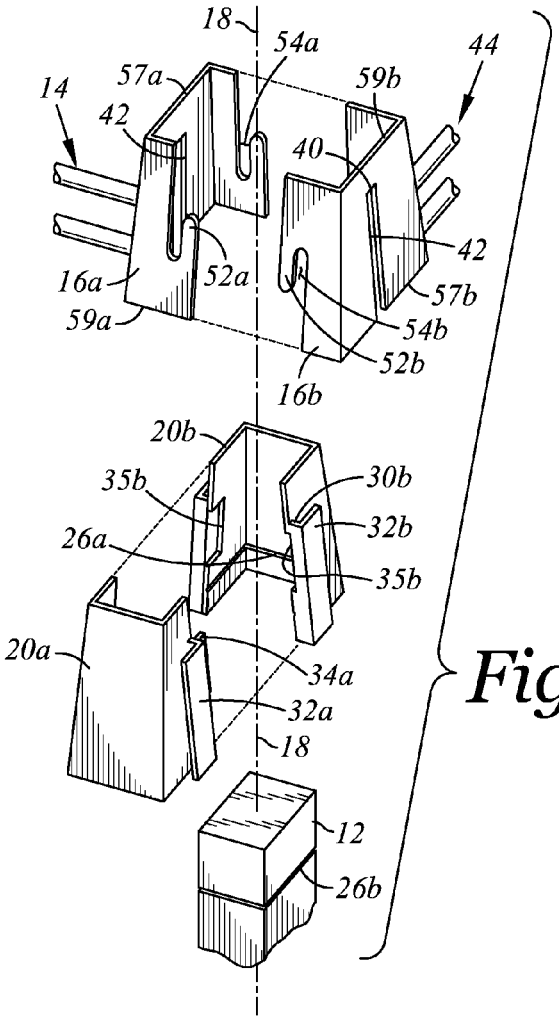
FIG. 14 is an exploded perspective view of a collar, sleeve and post having a rectangular cross-sectional shape.
Figure 15:
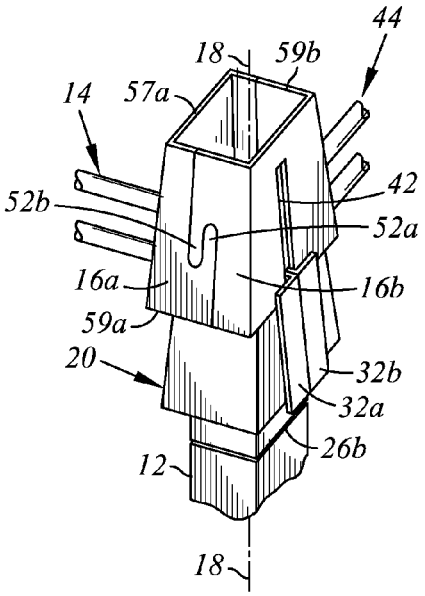
FIG. 15 is a partially exploded perspective view of the parts of FIG. 14 partially assembled.
Figure 16:
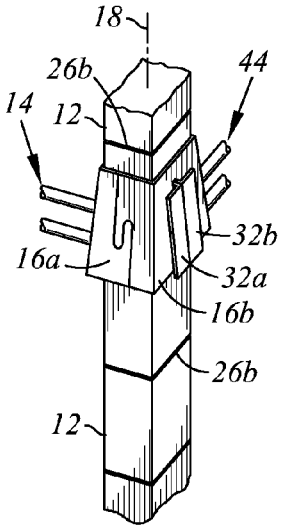
FIG. 16 is a perspective view of the parts of FIGS. 14 and 15 assembled on a post.

The above description uses a cylindrical post 12 with a circular cross-sectional shape. Other shapes can be used for the posts 12, with the collar parts 16*a*, 16*b* and sleeve halves 20*a*, 20*b* having conforming shapes so they wedge together when weight is placed on the shelves 14 and collar parts 16*a*, 16*b*. Referring to FIGS. 14-16, for example, instead of a post 12 with a cylindrical cross-section and circular grooves the post 12 may have a rectangular cross section with flat sides and grooves in each side, with a rectangular shaped sleeve 20 having a wedge shaped outer surface having a top dimensions smaller than the dimensions of the corresponding sides at the bottom of the sleeve to form a wedge shaped surface. As used herein, a rectangular shape includes a square. The mating connector collar part 16*a*, 16*b* may have a rectangular shape with the slot located on one of the flat sides of the post to engage support tabs 30 on a correspondingly shaped sleeve 20 and post 12.

Figure 17:
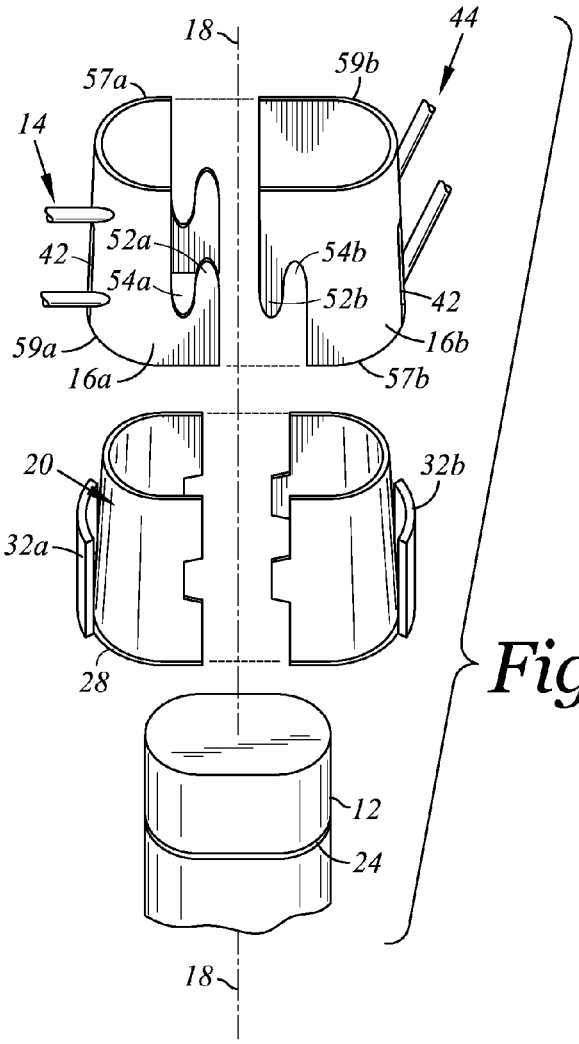
FIG. 17 is an exploded perspective view of a collar, sleeve and post having rounded ends and flat sides.
Figure 18:
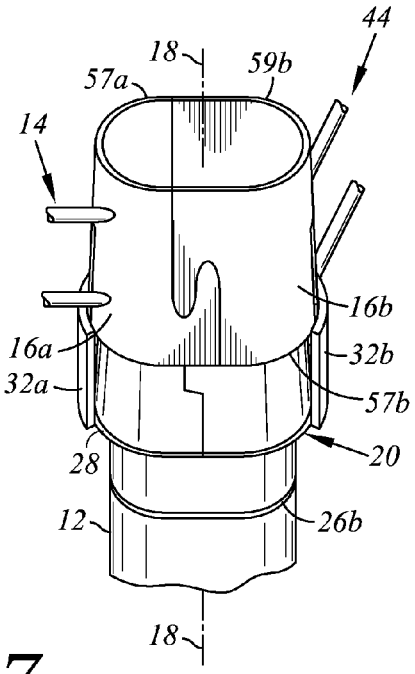
FIG. 18 is a partially exploded perspective view of the parts of FIG. 17 partially assembled.
Figure 19:
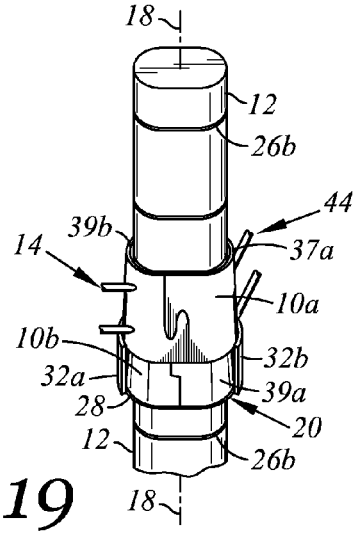
FIG. 19 is a perspective view of the parts of FIG. 18 with a post extending through the parts.

Referring to FIGS. 17-19, the post 12 may also have rounded ends joined by parallel flat sides, with a sleeve 20 having a conforming shape but a bottom larger than the top to form a wedge shape on at least one outer surface, preferably on two opposing surfaces and more preferably on all surfaces. The support tabs 30*a*, 30*b* would mate with the slot in the corresponding flat side of the collar part 16*a*, 16*b*. But the connection of slot and support tabs could also be located on the curved sides. Thus, the interlocking slot on the collar part 16*a*, 16*b* and the support tabs 30 and retaining flange 32 are not limited to a cylindrical shape.

Figure 10A:
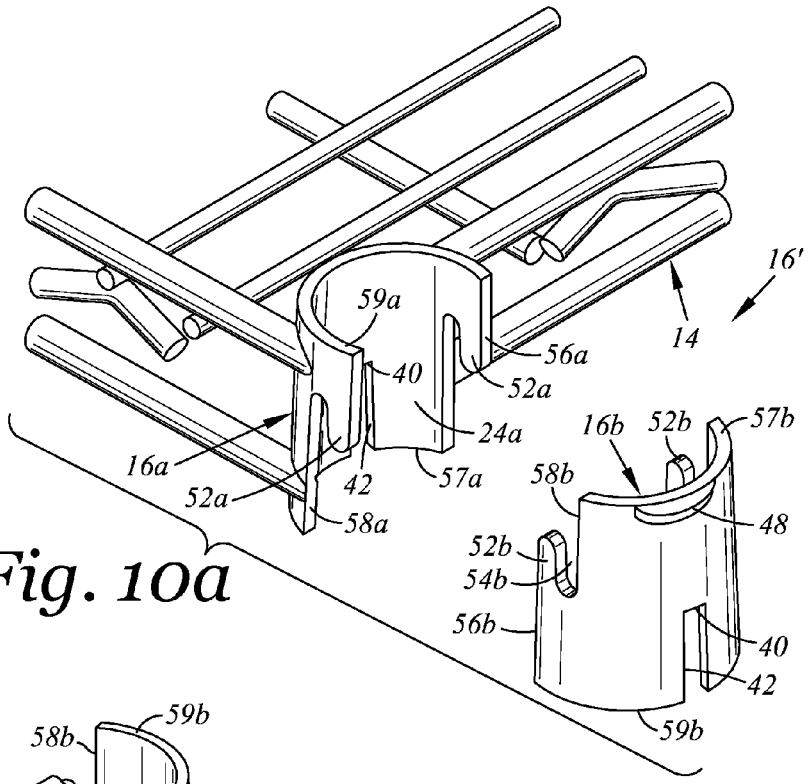
FIG. 10*a* is an exploded perspective view of a portion of a shelf fastened to a further embodiment of a collar part having an interlocking edge with a downward extending projection and upward extending recess and with a mating collar part having an upward extending projection and a downward extending recess.

Referring to FIGS. 10-12 a further embodiment is shown with interlocking collar parts. The interlocking collar parts interact with sleeve 20, support tabs 30, retaining flanges 32 and lip 33 as described above and that description is not be repeated here. The interlocking collar parts 16*a*', 16*b*' have interlocking projections 52 nesting in recesses 54 to impede lateral separation of the collar parts in a plane orthogonal to the longitudinal axis 18 with the further embodiment referred to herein as collar parts 16*a*' and 16*b*' with the collar assembly referred to as 16'. The collar parts 16*a*', 16*b*' each have two projections 52 extending along a length of and generally parallel to the axis 18, but the projections 53 are slightly inclined toward that axis as the mated collar parts 16*a*', 16*b*' have an inner surface that is tapered to force the sleeve 20 inward against the post 12 and depending on the orientation of a specific projection 52 on the collar 16' the orientation of at least the inside surface will vary. The inner surface of the projections 52, and preferably the projections 52 themselves, are generally parallel to the abutting surface of outer surface 24 of sleeve 20 during use so as to wedge against that surface 24 with relative motion of the projections 52 and surface 24 in one direction along axis 18.

The projections 52 are curved as they form a wall of the tube with a frusto-conical inner surface abutting sleeve 20 during use, so at least the inner surface of the projections 52 are preferably curved. The smallest diameter or opening of the joined collar parts 16' is smaller than the largest diameter or dimension of the sleeve 20. Each of the collar parts 16*a*', 16*b*' each extend more than 180 degrees around the longitudinal axis 18, but less than 570 degrees and preferably less than 270 degrees. The collar parts 16' each have two distal ends that are spaced apart to form a C-shape in cross section (viewed along axis 18) with a gap between those distal ends. The distal ends preferably comprise projections 52 that extend in the same direction on one collar part 16*a*', and extend in the opposing direction in the other collar part 16*b*'.

The projections on collar part 16*a*' which is connected to the shelf 14 may be referred to as the first projections and the projections on collar part 16*b*' may be referred to as the second projections. The orientation of the first and second projections along the axis 18 may change as described herein. The recesses 54 on the collar part 16*a*' which is connected to the shelf 14 may be referred to as the first recesses and the recesses 54 on collar part 16*b*' may be referred to as the second recesses. The orientation of the first and second recesses along the axis 18 may change as described herein. A recess 54 is located inward of each projection 52 on collar part 16'. As used herein, the phrase "located inward" refers to a location toward the circumferential center of collar part 16' with the slot and its end 40 and sides 42 being preferably located at the circumferential center of the collar part 16. Thus, referring to FIG. 10*a*, first projections 52*a* extend downward from opposing ends of first collar part 16*a*', with a first recess 54*a* located inward of each first projection 52*a*. Second projections 52*b* extend upward from opposing distal ends of second collar part 16*b*' with a second recess 54*b* located inward of each second projection. When the collar parts 16*a*, 16*b* are mated together or interlocked each first projection 52*a* fits in a different one of the second recesses 54*b* and each second projection 52*b* fits in a different one of the first recesses 54*a*.

Figure 10B:
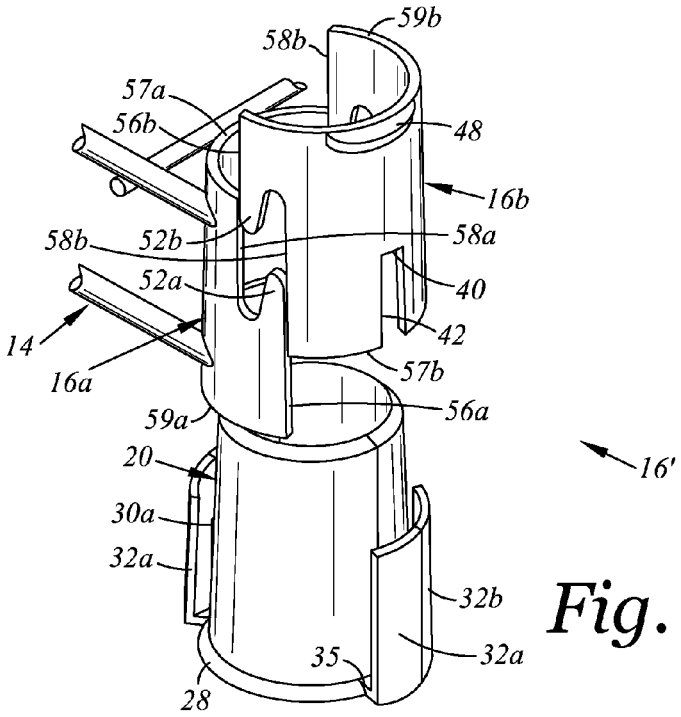
FIG. 10*b* is an exploded perspective view of a portion of a shelf fastened to a further embodiment of a collar part having an interlocking edge with an upwardly extending projection and downwardly extending recess and with a mating collar part having an downward extending projection and an upwardly extending recess, above a sleeve assembly of FIG. 2.
Figure 11A:
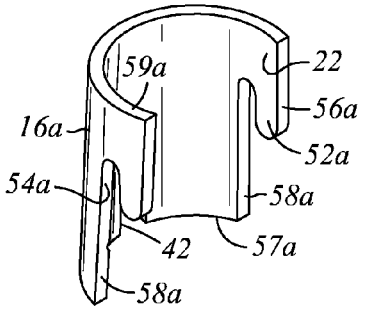
FIG. 11*a* is a top perspective view of a collar part having downwardly extending projections adjacent upwardly extending recesses as connected to the shelf in FIG. 10*a* and as forming the locking collar part in FIG. 10*b;*
Figure 11B:
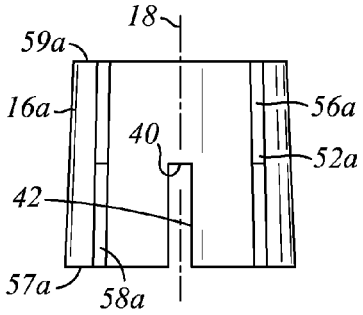
FIG. 11*b* is a front view of the collar part of FIG. 11*a;*

Referring to FIG. 10*b*, first projections 52*a* extend upward from opposing ends of first collar part 16*a*', with a first recess 54*a* located inward of and adjacent to each first projection 52*a*. Second projections 52*b* extend downward from opposing distal ends of second collar part 16*b*' with a second recess 54*b* located inward of and adjacent to each second projection. When the collar parts 16*a*, 16*b* are mated together or interlocked each first projection 52*a* fits in a different one of the second recesses 54*b* and each second projection 52*b* fits in a different one of the first recesses 54*a*.

Referring to FIGS. 10-13, the projections 52 on two mating or interlocking collars 16*a*', 16*b*' thus extend in opposing directions generally parallel to longitudinal axis 18 and mate with recesses 54 in the other collar part that are located circumferentially inward of the projections 52. Thus, as shown in FIG. 10*a*, first collar part 16*a*' has two downwardly extending first projections 52*a* at each of its distal ends, with upwardly extending first recess 54*a* inward of and adjacent to each projection 52*a*. The projections 52 are inclined to align with the shape of the outer surface 24 of sleeve 20. The projections 52 preferably have straight distal edges 56 with round ends and the recesses 54 are preferably rounded to conform to the shape of and mate with the rounded ends of projections 52. Thus, the second collar part 16*b*' has downwardly extending projections 52*b* at its distal ends and an upwardly extending recess 54*b* inward of and adjacent to each depending projection 52*b*.

The recesses 54 preferably have a circumferentially inward edge 58 that is straight and generally parallel with the longitudinal axis 18. When assembled, the upwardly extending projections 52*a* fit into upwardly extending (downward facing) recesses 54*b*, and the downwardly depending projections 52*b* fit into the downwardly extending (upwardly facing) recesses 54*a*. The straight edges 56 and 58 abut each other so that each of the straight edges 56*a* on the distal edge of one of the upward projections 52*a* abuts a different one of the straight edges 58*b* on the mating recess 54*b* which recess receives one of the two projections 52*a*.

Figure 11C:
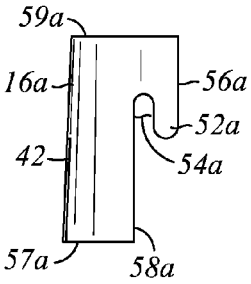
FIG. 11*c* is a left side view of the collar part of FIG. 11*a*, with the opposing side view being a mirror image thereof.
Figure 12A:
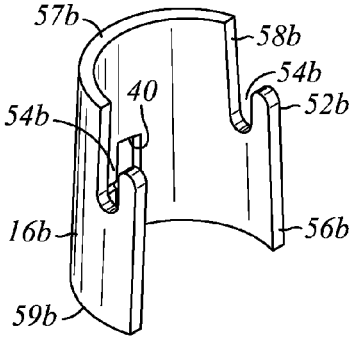
FIG. 12*a* is a top perspective view of a collar part having upwardly extending projections adjacent downwardly extending recesses as forming the locking part in FIG. 10*a* and as connected to the shelf in FIG. 10*b;*
Figure 12B:
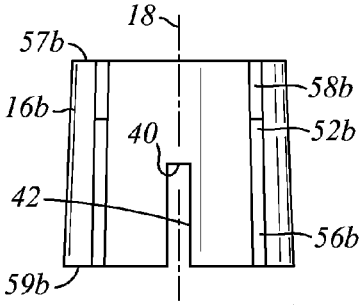
FIG. 12*b* is a front view of the mating collar part of FIG. 12*a;*
Figure 12C:
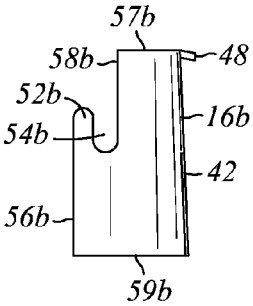
FIG. 12*c* is a right side view of the mating collar part of FIG. 12*a*, with the opposing side view being a mirror image thereof.

Viewed from the sides, orthogonal to the longitudinal axis 18 as in FIGS. 11C and 12C, the curved juncture of the collar parts 16*a*', 16*b*' resembles an S or a mirror image thereof, depending on which side is being viewed. The projections 52 and adjacent recesses 54 form a crenelated shape with rounded corners. The projections 52 and recesses 54 interlock to form a connection that resists radially outward forces that would otherwise separate the collar parts 16*a*', 16*b*'.

Rounded ends on projections 52 and rounded bottoms on recesses 54 are preferred as the curves reduce stress concentrations. But other shapes could be used, including beveled corners on square projections 52 and recesses 54, or even sharp corners, or triangular projections 52 and mating portions of recesses 54. The projections 52 have distal edges 56 that are less than 180 degrees apart measured along longitudinal axis 18 and thus form a gap between those distal edges. Recesses 54 preferably have both sides of the recess less than 180 degrees apart measured along longitudinal axis 18, with one side of the recess 54 being formed by an inward side of the projection 52 so each recess 54 adjoins a projection 52. Thus, preferably the projections 52 have a distal edge more than 180 degrees apart and have an inner edge closer than 180 degrees apart. The rounded ends of the projections 52 also make it easier to mate the projections with the recesses 54 so the parts can be mated by moving one or both of them along axis 18.

The recesses 54 are preferably separated by a back portion 57 that extends between edges 58 of the two recesses 54 on each collar part. Thus, back portion 57*a* extends between straight edges 58*a*, 58*a* of collar part 16*a*', and back portion 58*b* extends between straight edges 58*b*, 58*b* of collar part 16*b*'. In the illustrated embodiment back 57 has a cylindrical curve that joins the edges 58.

The distal edges 56 of the projection are separated by a base portion 59 that also joins the distal edge the projections together. Thus, base portion 59*a* extends between straight edges 56*a*, 56*a* of collar part 16*a*', and base portion 59*b* extends between straight edges 56*b*, 56*b* of collar part 16*b*'. In the illustrated embodiment base 59 has a cylindrical curve that joins the edges 56. The back 57 is on the opposite end of the collar or connector 16' as the base 59. Moreover, the base 59 extends around an arc of greater than 180 degrees, while the back 57 extends around an arc of less than 180 degrees. Each end of the assembled connector 16' has an upper edge made up of a back 57 and a back 59, as does the lower edge. Each of the back 57 and base 59 are opposing ends of a curved wall forming the generally cylindrical connector 16' having the frusto-conical inward facing surface that wedges against sleeve 20 to clamp the connector 16' and sleeve 20 to the post 12. In the connector 16' of FIGS. 1, 6 and 11, the upper end of the connector having back 57*b* and base 59*a* forms a smaller internal circumference than the lower inner circumference formed by back 57*a* and base 59*b*. Because the wedging action of connector 16' uses a slightly tapered inner surface on the connectors, the upper circumference and upper diameter of the connector are smaller than the corresponding circumference and diameter at the bottom of the connector 16'.

Figure 25:
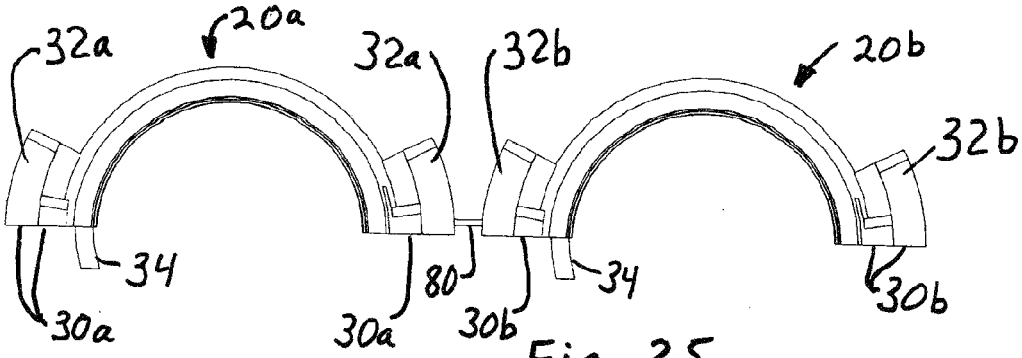
FIG. 25 is a top plan view of the sleeve of FIGS. 24 and 27.
Figure 27:
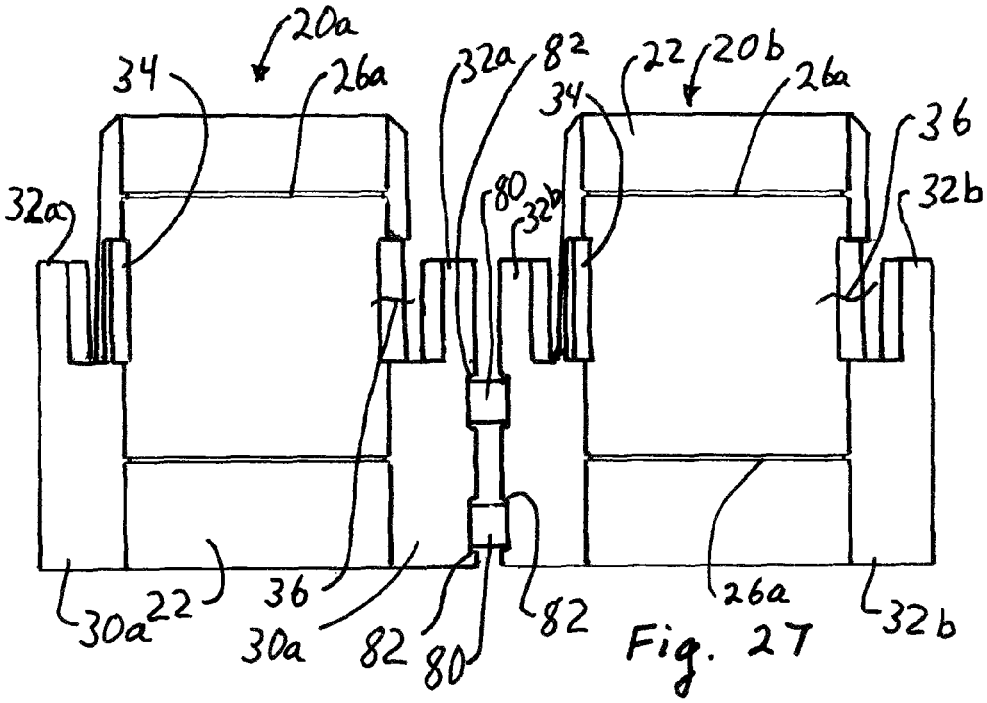
FIG. 27 is a front plan view of the sleeve of FIGS. 24 and 26.
Figure 28:
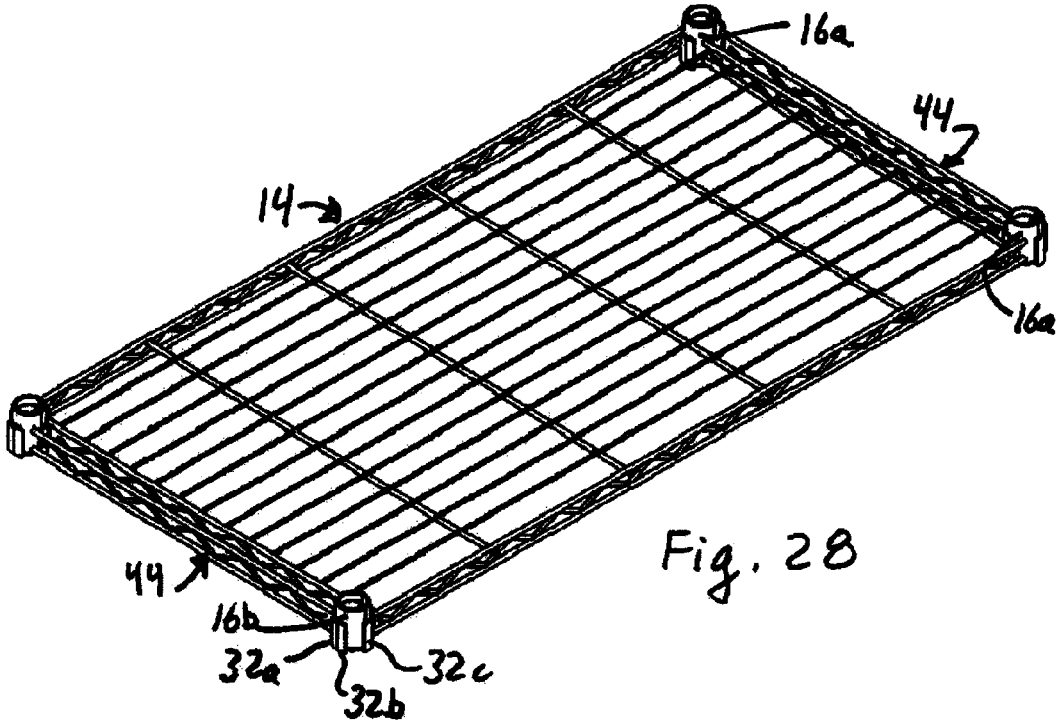
FIG. 28 is a perspective view of a shelf with a further embodiment of four sleeves and four collar parts and two end frames.
Figure 29:
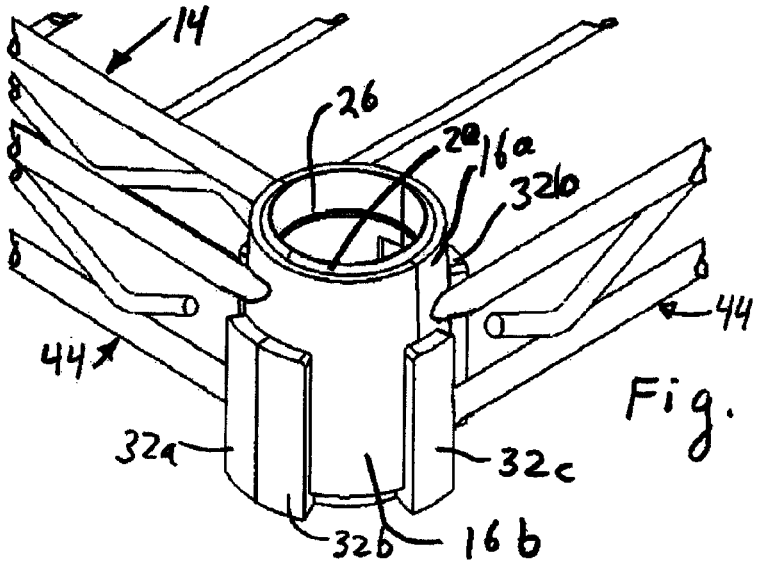
FIG. 29 is an enlarged view of a corner of the shelf of FIG. 28.

The collar parts 16*a*', 16*b*' may have the projections 52 and recesses 54 extending the opposite directions as described above. Referring to FIG. 11, the connector 16' has a shelf 14 with a top surface upon which items rest during use and each projection 52*b* on the second collar 16*b*' connected to the shelf is directed downward, away from the top of the shelf. Each projection 52*a* on first connector 16'*a*' is directed upward, toward the top of the shelf. In contrast, as seen in FIGS. 25 and 27-28, the second connector 16*b*' connected to the shelf 14 may have each projection 52*b* extending axially upward, toward the top of the shelf and each projection 52*a* on first connector 16'*a*' directed axially downward, away from the top of the shelf.

In more detail and referring to FIG. 10*b*, first collar part 16*a*' has two upwardly extending projections 52*a* at each of its distal ends, with a downwardly extending recess 54*a* inward of and adjacent to each projection 52*a*. The projections 52 are inclined to align with the shape of the outer surface 24 of sleeve 20. The projections 52 preferably have straight distal edges 56 with round ends and the recesses 54 are preferably rounded to conform to the shape of and mate with the rounded ends of projections 52. The second collar part 16*b*' has downwardly extending projections 52*b* at its distal ends and an upwardly extending recess 54*b* adjacent each depending projection 52*b*. The recesses 54 preferably have a circumferentially inward edge 58 that is straight and generally parallel with the longitudinal axis 18. When assembled, the upwardly extending projections 52*a* fit into upwardly extending recesses 54*b*, and the downwardly depending projections 52*b* fit into the downwardly extending recesses 54*a*. In use the straight edges 56 and 58 abut each and preferably abut against other so that each of the straight edges 56*a* on the distal edge of one of the upward projections 52*a* abuts against a different one of the straight edges 58*b* on the mating recess 54*b* which recess receives one of the two projections 52*a*.

The collar parts 16*a*', 16*b*' have slots with slot sides 42 and slot ends 40 located to fit over the support tabs 30*a*, 30*b* on the sleeves 20 as described above. The collar parts 16*a*', 16*b*' are used as described for collar parts 16*a*, 16*b* except the interlocking projections 52 and recesses 54 provide increased resistance to separating the parts of connector 16'. Because the projections 52 require vertical movement to engage the recesses 54, some relative vertical motion is required for engaging and disengaging collar parts 16*a*' and 16*b*' whereas such vertical movement on the prior embodiments of collar parts 16*a*, 16*b* was defined only by the movement to engage slots and slot sides 42 and slot ends 40 with the support tabs 30*a*, 30*b* and retaining flanges 32*a*, 32*b*.

Figure 13:
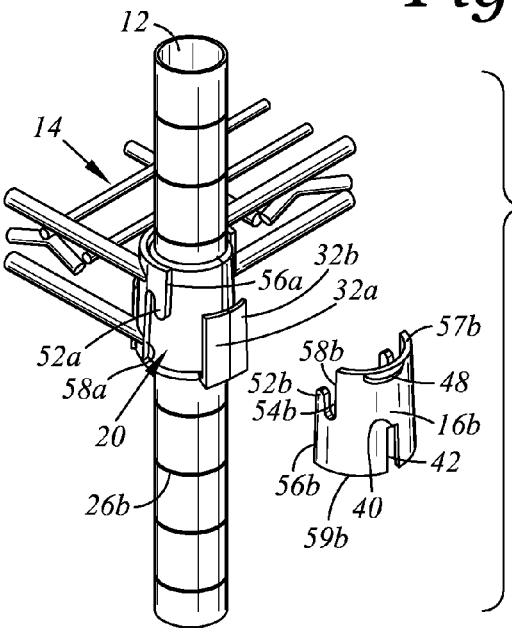
FIG. 13 is a partial exploded perspective view showing a shelf having a collar with downwardly extending projections adjacent upwardly extending recesses on one of the posts and sleeves of FIG. 10*b* and with a mating locking collar part separated therefrom.

Referring to FIGS. 10*a* and 13, the shelf 14 has its corner connected to collar part 16*a*' at each corner of the shelf, and that collar part has projections 52*a* extending downward. Referring to FIG. 10*b*, the shelf 14 has the corner collar part 16*a*' with projections 52*a* extending upward. That orientation has some advantages discussed later. But in either orientation, the projections 52 are preferably generally aligned with the longitudinal axes 18 of posts 12 (allowing for the slight inward taper of the frusto-conical surfaces) and generally perpendicular to the plane of the shelf 14. The corner posts 12 have a sleeve 20 positioned at the desired location of a shelf 14, preferably with one or more internal ribs 26 engaging a mating groove or grooves 26*b* in the post 12.

The space between distal ends 56*a* of the connector 16*a*' are wide enough so the post 12 can fit between the distal ends 56*a*, even if the ends 56*a* are resiliently deformed (without elastic deformation) to place the posts inside the connectors or vice versa. The collar parts 16*a*' are each placed on a different but corresponding corner post 12 above the sleeve 20 on that post and the collar part 16*a*' is moved along axis 18 of post 12 so the inward surface on the collar part 16*a*' mates with the outward facing inclined surface 24 on the sleeve 20 to wedge against the sleeve and post and thereby to temporarily fasten the engaged collar part 16*a*', sleeve 20 and post together, with the slot end 40 abutting the top of support tabs 30 and the slot sides 42 preferably abutting against sides of the support tabs 30. This wedging occurs because the connector 16*a*' is tapered and its smallest opening or diameter is smaller than the largest diameter or dimension of the sleeve 20 that must pass through the mating part of connector 16*a*'. When at least three of the four collar parts 16' are fastened to its corresponding corner post 12, the shelf 14 is fairly self-supporting, with four collar parts 16 being preferred.

Because the distal ends 56*a* of connectors 16*a*' are not connected to each other and have a gap between them, the shelf 14 can be pulled out of engagement with the corner posts 12 when enough weight or force is applied to spread the distal ends apart enough to pull the post through the gap between the distal ends of at least one connector 16*a*'. A locking member 44 (FIG. 8) prevents that with the locking member comprising the mating collar part such that if the shelf has collar part 16*a*' as in FIG. 10*b* with projection 52*a* extending upward, then the locking part is collar part 16*b*' with the projection 52*b* extending downward. If the shelf has collar part 16*b*' with projection 52 extending downward as in FIG. 13, then the locking part has collar part 16*a*' with projection 52 extending upward. The locking members can be each fastened separately and unconnected to each other, or they can be fastened in pairs on opposing ends of a connecting member as in FIG. 8 which shows a locking assembly 44 with a connecting member 16*b* and a locking part at each opposing end.

Figure 8:
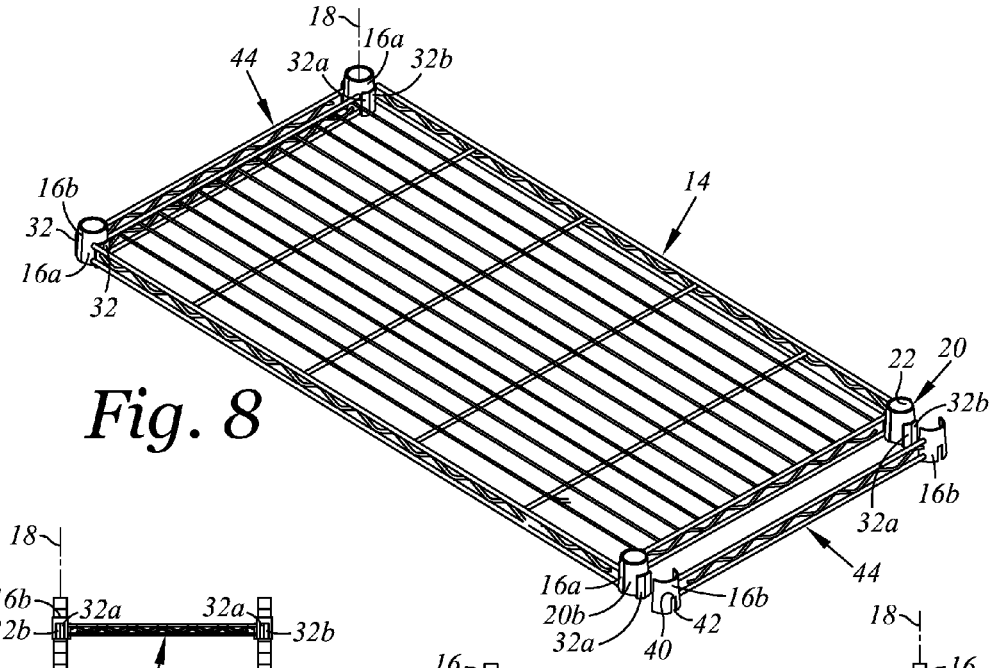
FIG. 8 is a partially exploded view of a shelf with four sleeves and collar parts with an end frame and two collar parts offset from the adjacent sleeves and shelf.
Figure 9B:
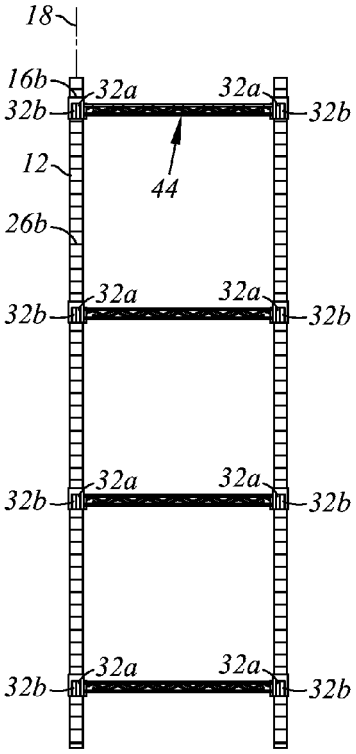
FIG. 9*b* is a right side plan view of the shelf of FIG. 9*b*, with the left side view being a mirror image thereof.
Figure 9A:
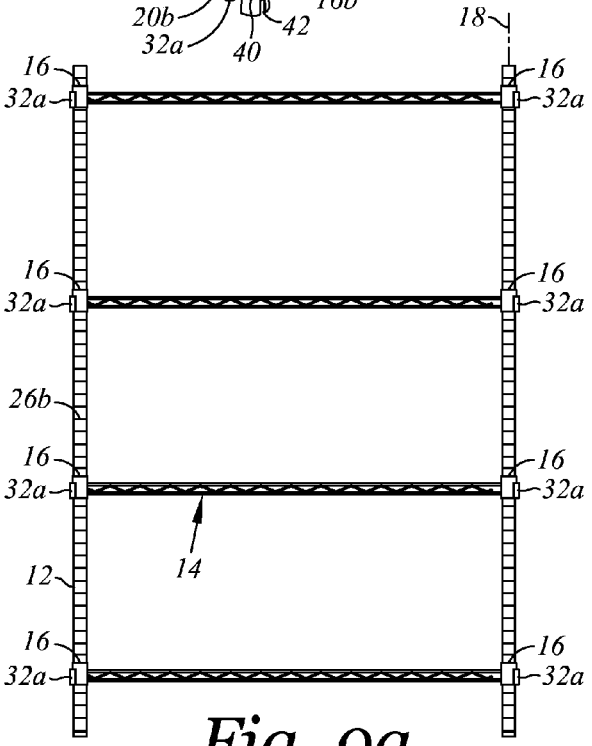
FIG. 9*a* is a front plan view of a shelving unit with four shelves and four posts, with the back view being a mirror image thereof.

For a kit, two locking assemblies 44 may be provided, with each locking assembly having an elongated member 42 with a collar part, shown in FIG. 8 as collar part 16*a* fastened to opposing ends of each member 42 and aligned to mate with the opposing collar part 16*b* during use. The collar parts attached to the shelf 14 can be either part 16*a*, 16*b*, 16*a*' or 16*b*' depending on the configuration of the shelf 14 and locking assemblies 44 that are used, with the other collar part used to interlock the collar parts together.

If the connectors 16*a*' or 16*b*' are used then the space between distal ends 56*a* of the connector 16*a*' on opposing ends of the locking member 42 are wide enough so the post 12 can fit between the distal ends 56*a* on the locking member 42, even if the ends 56*a* are resiliently deformed (without permanent deformation) to place the posts inside the connectors 16*a*' or 16*b*'. If the projections 56 on the collar part 16' connected to the shelf extend downward as in FIGS. 10*a* and 13 then the collar parts 16*b*' on the locking connector 42 may be placed onto two adjacent corner posts at a location below the mating collar parts 16*a*' and the collar parts are then engaged with the projections 52 of one part fitting into the recesses 54 of the other part and with the slots having sides 42 and ends 40 fitting over the support tabs 30 of the sleeve 20. This is preferably done before moving the connected parts 16*a*', 16*b*' onto the sleeves 20 when the shelf 14 has a collar part 16' with projections 52 extending downwardly. Alternatively, the locking assembly 44 may be placed on two adjacent sleeves 20 to engage two adjacent corner posts 12, with the projections 52*a* fitting into recesses 54*b* on an opposing collar part.

After the locking assembly 44 is installed, then the shelf 14 and its connector 16*a*' with downwardly extending projections 52*a* and upwardly extending recesses 54*b* may have posts 12 enter the collar parts 16*b*' and the collar parts and the shelf moved downward to mate with the recesses 54*b* and projections 54*b* in the locking connector. The rounded ends of the projections 52 help align the parts, and the straight edges 58*a*, 58*b* also help align the parts along axis 16, making engagement fast and easy. A locking member 42 on opposing ends of a shelf assembly locks the shelf to the posts. Alternatively, the mating connectors may be on an adjacent shelving unit rather than on a locking assembly 44. Further, the locking parts may be attached separately, unconnected by locking member 44, using manipulating tab 46 for ease of manipulation or by grabbing the sides of the parts 16'.

If the shelf 14 has collar parts 16*a*' with projections 52*a* extending upward as shown in FIG. 10*b* then the assembly is easier than if the projection extends the other way. The shelf 14 and collar parts 16*a*' with projections 52*a* extending upward is placed on the sleeve 20 which is fastened at a desired location on post 12 by interlocking ribs 26*a*, 26*b*. The wider end of the slightly tapered or conical shaped collar part 16*a*' is at the bottom so the collar part wedges the sleeve 20 against the post 12 and the slot sides 42 hold support tabs 30*a*, 30*b* together while the slot end 40 may abut against the top of the support tab 30, with the collar part fitting inside the retaining flanges 32*a*, 32*b*. The interlocking collar part 16*b*' has projections 52 extending downward from the end of the collar part with the smallest diameter so it can be inserted from the top-down with the downward extending projections 52*b* fitting into corresponding downward extending recesses 54*a*, and with the upward extending projections 52*a* fitting into corresponding upward extending recesses 54*b*. The interlocking collar part 16*b*' may have slot sides 42 abut the sides of support tabs 30*a*, 30*b* with the slot end 40 abutting the top of the support tabs 30*a*, 30*b*. The interlocking collar part 16*b*' can be attached independently, or it can be on an adjacent shelf 14, or two of the collar parts 16*b*' can be fastened to opposing ends of an elongated member to form end frame 44.

A simplified shelving unit would include four corner posts 12, at least one and preferably two or more shelves 14 with first connectors 16*a* or 16*a*' on each corner of the shelf, and two locking members 42 for each shelf 14, and four sleeves 20 for each shelf. A shelving kit preferably includes those parts and more preferably includes two, three, four, five or six shelves and twice the number of locking members 42 as there is shelves and four times the number of sleeves 20 as there is shelves. More shelf assemblies 40 may be provided. One or more, or all of the locking members 42 may be replaced by two separate locking parts 16*b*, 16*b*' which are separately attached or removed. A kit may include the above combination of parts and combinations thereof.

The shelves 12 and collar parts 16, 16' are preferably made of metal, but could be made of plastic or other non-metal materials, recognizing that the weight that can be supported on the shelves will probably be less than with metal. It is believed possible to have more than two projections 52 and two recesses 54 on each collar part 16', but a stronger connection is believed achievable with two projections and two recesses. A shorter slot end 40 and shorter slot sides 42 also provide a stronger collar part 16'. The specific combination of shapes and sizes will vary according to the particular design using the features described herein.

The above description uses a cylindrical post 12 with a circular cross-sectional shape. Other shapes can be used for the posts 12, with the collar parts 16*a*', 16*b*' and sleeve 20 having conforming shapes so they wedge together when weight is placed on the shelves 14. For example, FIGS. 14-16 shows a rectangular shaped post 12 with a rectangular shaped sleeve 20 having a wedge shaped outer surface having a top dimensions smaller than the dimensions of the corresponding sides at the bottom of the sleeve to form a wedge shaped surface. As used herein, a rectangular shape includes a square with sides of equal length. The mating connector 16' has rectangular shaped collar parts 16*a*', 16*b*' with projections 52 engaging recesses 54 along one of the flat sides of the sleeve 20, and with a correspondingly shaped sleeve 20 and post 12. Slots having sides 42 and end 40 extend from a bottom edge of the collar parts 16' and are sized to fit over the support tabs 30 extending from sleeves 20 as described above. In the depicted embodiment the projections 52 on the shelf 14 extends upward, in the same direction as the slot with end 40 and sides 42, but the projections 52 could extend downward as in FIG. 10*a*.

The sleeves 20*a*, 20*b* shown in FIG. 14 have both locking recess 36 on a single sleeve part 20*b*, with both locking tabs 34 on a single sleeve part 20*a*. This arrangement of locking tabs and locking recesses on the sleeve may be used with or without the interlocking projections 52 and recesses 54. The sleeves 20 and collar parts 16 shown in FIG. 14 have long support tabs 30 measured along the length of axis 18, and the support tabs 30 extend along the axial length of the locking recesses 34. As a result of this length of support tabs 30, the slot sides 42 in the collar parts are also long. If the length of the slot sides 42 is too long the collar parts 16 become weak at the location of the slot. The actual construction used will vary with the design, with or without the interlocking projections 52 and recesses 54.

FIGS. 17-19 show a post 12 with rounded, semi-circular ends and flat sides, with a sleeve 20 having a conforming shape but a bottom larger than the top to form a wedge shape on at least one outer surface and preferably on two opposing surfaces and more preferably on all surfaces. The projections 52 on the collar parts 16*a*', 16*b*' mate with the aligned recesses 54 on the flats of the sleeve 20 and post 12. But the connection of projections 52 could be located on the curved sides. In the depicted embodiment the projections 52 on the shelf 14 extends upward, in the same direction as the slot with end 40 and sides 42, but the projections 52 could extend downward as in FIG. 10*a*. In the depicted embodiment of FIGS. 14-16, the projections 52 on the shelf 14 extends upward, in the same direction as the slot with end 40 and sides 42, but the projections 52 could extend downward as in FIG. 10*a*.

FIGS. 14-19 show that the interlocking projections 52 and recesses 54 are not limited to a cylindrical shape as in FIGS. 1-9, and that the collars 16, 16' and sleeves 20 are not limited for use with posts 12 having circular cross-sections. The shape of the collars 16, 16' and sleeves 20 may be adjusted to conform to the cross-sectional shape of the post 12.

Referring to FIGS. 20-23, when collar parts 16*a*, 16*b*, 16*a*', 16*b*' are made of metal they are preferably cut from a flat sheet 60 of metal and then bent into shape. The sheet 60 is preferably stainless steel but other metals could be used, with the type of metal and its thickness varying with the desired strength of the resulting collar part 16*a*, 16*b*, 16*a*', 16*b*' being formed. The sheet 60 before cutting has a four sided shape with two opposing sides 62 inclined at a slight angle toward each other, with the angle of inclination varying with the amount of taper of the final collar part 16*a*', 16*b*'. The sides 62 join a first, short end 64 and a second, long end 66 of the sheet 60. The first and second ends 64, 66 are parallel and slightly curved, with the amount of curvature varying with the diameters of the top and bottom of the finished collar 16, 16'. The shorter end 64 forms the end of the collar 16, 16' having the smaller diameter and the longer end 66 forms the portion of the collar 16, 16' having the larger diameter, with the collar parts 16*a*, 16*b*, 16*a'*, 16*b'* narrowing and tapering from the larger diameter end toward the smaller diameter end.

Figure 21:
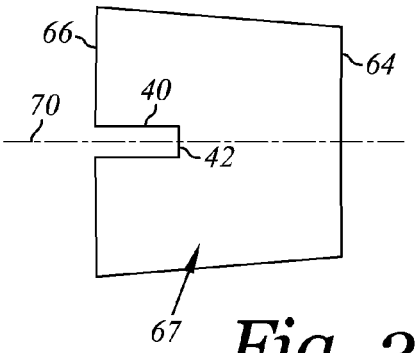
FIG. 21 is a top plan view showing a sheet of fan-shaped metal with a slot for forming frusto-conical collar parts which do not interlock.

Referring to FIG. 21, to form the collar part 16*a* or 16*b*, a slot having sides 42 and end 40 is cut into the sheet 60 to form a shaped blank 68, with the slot preferably extending along the centerline 70 of the shaped blank 68 and opening onto what used to be the longer end 66. The blank 67 is preferably symmetric about centerline 70 and the slot extends from the longer end 66 inward along centerline 70 to closed end 40 with sides 42 that are preferably parallel. The shaped blank 67 is then bent into the shape of collar part 16*a*, 16*b* as shown in FIGS. 1-9, with the shelf 14 or end frame 44 or manipulating tab 46 being fastened to an outer surface of the shaped collar part 16*a*, 16*b* as desired. The bending may be achieved by forcing or bending the shaped sheet 67 around a tapered mandrel or die using one or more mating dies with correspondingly shaped cavities. The mandrel or die will have a desired taper and the resulting collar part 16*a*, 16*b* may be slid axially off the die or mandrel. Thus, the cut or shaped sheet 67 is bent or formed into the tapered shape of collar parts 16*a*, 16*b*. The curvature on ends 64, 66 is selected according to the amount of taper desired for the collar parts 16*a*, 16*b*, with the taper being selected to wedge against sleeve 20 and clamp the sleeve against a post 12 during use.

Figure 22:
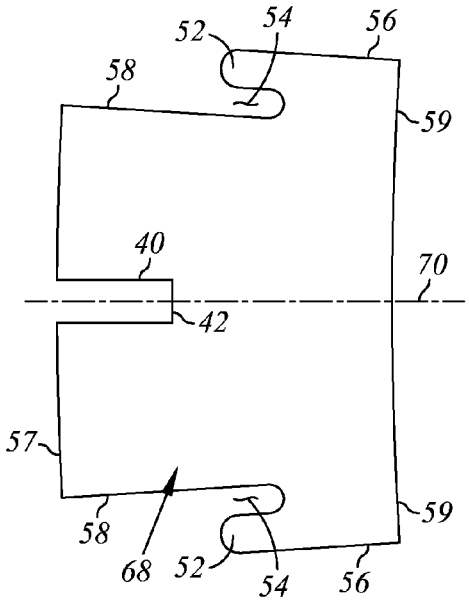
FIG. 22 is a top plan view showing a sheet of fan-shaped metal with a slot, projections and recesses to forming a first frusto-conical collar part which may interlock.

Referring to FIG. 22, the sheet 60 of material is cut differently to form interlocking collar parts 16*a'*, 16*b'*. Referring to FIGS. 10*a*, 11*a*-11*c*, 13 and 22, to form collar part 16*a'* (or to form collar part 16*b'* in FIG. 10*b*), the sheet of material 60 is cut to form a shaped blank 68 that has two projections 52 extending toward what used to be the longer end 66 and two recesses 54 extending opposite the projections and a single slot having sides 42 and end 40, with the slot preferably extending along the centerline 70 of the shaped blank 68 and opening onto what used to be the longer end 66. The blank 68 is preferably symmetric about centerline 70 and the slot extends from the blank's longer end 66 inward along centerline 70 to closed end 40 with sides 42 that are preferably parallel. The projections 52 extend toward what will be the larger diameter end of the collar 16' and the recesses 54 extend toward the smaller diameter end of the collar. The slot with its closed end 40 extends in the same direction as recesses 54 and opposite the direction of the projections 52. The length of what used to be longer end 66 is shortened to form back 57 by having the straight edge 58 of the recesses 54 extend to what used to be the longer end 66. The length of the shorter end 64 is unchanged and will become base 59 extending between distal edges 56 of projections 52 on collar part 16*a'*.

The metal sheet 60 may be cut using any suitable known cutting technique or any technique developed in the future. Stamping the sheets 60 from a continuous sheet of material using a die cutter, and then stamping the sheet 60 with a die cutter to form shaped flat sheet 67 or 68, is believed preferable. Cutting by plasma cutters, laser and ultra-high pressure water are also believed suitable. The cut edges may be ground to smooth them out if needed and the corners may be rounded to avoid cuts during handling.

The sheet of material 60 is thus cut to form shaped blank 68 having projection 52 extending toward the longer end 66 and what will become the larger diameter end 57 of collar part 16*a'*. Projection 52 preferably has straight edges 56, 58 as previously described, and a recess 54 separating the projection 52 from the straight edge 58 with side 58 extending from the recess 54 to the base 59 joining distal ends of the collar part 16*a'*. The projection 52 is formed on each side 62*a*, 62*b* of the sheet 60, resulting in shaped blank 68. The straight edges 56, 58 are slightly inclined outward from the centerline 70 the sheets 60, 68 which centerline preferably passes midway between opposing sides 62*a*, 62*b* and midway between recesses 54. The length of longer end 66 is shortened by the straight edges 58 of recess 54 to form what will become a larger diameter, back 57 of a collar 16*a'*. The length of shorter end 64 is not changed and it will become the smaller diameter end 59 of collar 16*a'*.

The shaped blank 68 is then bent into the shape of collar part 16*a'* as shown in FIGS. 10*b*, 11*a*-11*c* and 13. The projections 52 extend downward during use with the collar part 16*a'* being fastened to the shelf 14. The projections 52 extend downward during use when the collar parts 16*b* are attached to end frame 44 or are separately attached as in FIG. 10*b*. The bending of shaped blank 68 takes what was originally the longer length end 66 (FIG. 20) but was shortened in forming the shaped blank 68 (FIG. 21) and bends that end to form the larger diameter but shorter length back 57 that extends between the edges 58 of recesses 54. The bending may be achieved by forcing or bending the shaped sheet 68 around a tapered mandrel or die using one or more mating dies with correspondingly shaped cavities. The mandrel or die will have a desired taper and the resulting collar part 16*a'* (or 16*b'* in FIG. 10*b*) may be slid axially off the die or mandrel. Thus, the cut or shaped sheet 68 is bent or formed into the tapered shape of collar part 16*a'* which has projections extending downward toward larger diameter end of the collar and away from end 57 that has a smaller diameter or smaller radius of curvature. The taper between ends or edges 57, 59 is selected to wedge against sleeve 20 and clamp the sleeve against a post 12.

Figure 20:
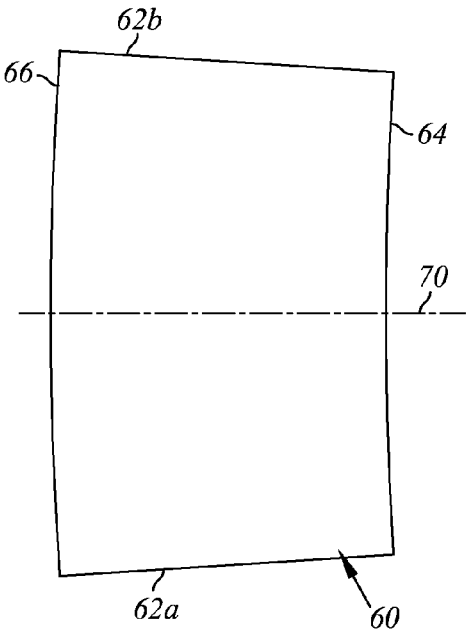
FIG. 20 is a top plan view showing a sheet of fan-shaped metal from which collar parts may be formed.
Figure 23:
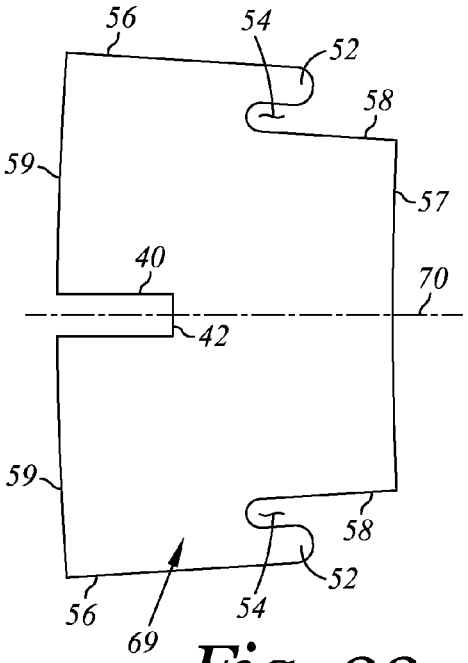
FIG. 23 is a top plan view showing a sheet of fan-shaped metal with a slot, projections and recesses to forming a second frusto-conical collar part which may interlock.

Referring to FIGS. 20 and 23, the flat sheet of metal 60 is also cut and bent differently to form collar part 16*b'* in FIGS. 10*a*, 12*a*-12*c* and 13 (and collar part 16*a'* in FIG. 10*b*). In these figures the projections 52 extend downward during use toward a larger diameter end of the collar and the recesses 54 extend upward toward the larger diameter end of the collar. The projections 52 extend in the same direction as the slot with interior end 40 and the recesses 54 extend in the opposite direction. The sheet of material 60 (FIG. 20) is cut to form shaped blank 69 having projection 52 extending toward the shorter end 64 and what will become the smaller diameter end of collar part 16'. Projection 58 has straight edges 56, 58 as previously described, and a recess 54 separating the projection 52 from the straight edge 58. The projection 52 is formed on each side 62*a*, 62*b* of the sheet 60 (FIG. 20), resulting in shaped blank 59 (FIG. 23). The straight edges 56, 58 are slightly inclined inward toward centerline 70 of the sheets 60, 59 which centerline passes midway between opposing sides 62*a*, 62*b* (FIG. 20-23). The length of longer end 66 is unchanged as it extends between the outer straight edges 56 of projections 52 to form what will become a larger diameter end 59 of the collar part 16*b'* (or 16*a'*). The length of shorter end 64 is not changed and it will become the smaller diameter end 57 of the collar part 16*a'* or 16*b'*. As with the sheet 68 of FIG. 21, the sheet 69 of FIG. 28 has the projections 52 and recesses 54 are cut to form complementary, nesting shapes 52 and recesses 54 preferably with rounded ends. The slot having sides 42 and closed end 40 extends along centerline 70, with the shaped blank 69 preferably being symmetric along centerline 70. In shaped blank 69 the slot 70 extends in the same direction as projections 52 and in the opposite direction as recesses 54. The slot extends from the longer side 66 (FIG. 20) of the blank and what becomes the larger diameter end of the collar part. The shaped blank 69 may be formed or cut using the same methods as shaped blanks 67 and 68.

The shaped blank 59 is then bent into the shape of collar part 16*b*' as shown in FIGS. 10*a*, 12*a*-12*c* and 13 (and 16*a*' in FIG. 10*b*) 10-13, with projections 52 extending upward during use, toward the narrower diameter end of the collar 16'. The forming process similar to that for of forming shaped sheet 68. What was originally the shorter length end 64 (FIG. 20) is shortened further because of the material removed to form projections 52 and recesses 54. The bending of shaped blank 59 takes the longer length end 66 (FIG. 20) which remains the longer end 59 in the shaped blank 59 (FIG. 23) and bends that longer end to form the larger diameter, longer length end 59 that extends between the outer distal ends or edges 56 of projections 52. The bending may be achieved by forcing or bending the shaped sheet 59 around a tapered mandrel or die using one or more mating dies with correspondingly shaped cavities. The mandrel or die will have a desired taper and the resulting collar part 16*b*' (or 16*a*') may be slid axially off the die or mandrel after forming. Thus, the cut or shaped sheet 59 is bent or formed into the tapered shape of collar part 16*a*' (or 16*b*') which has projections 52 extending away from end 59 that has a larger diameter or radius of curvature than end 57 which has a smaller diameter or radius of curvature. The taper between ends or edges 57, 59 is selected to wedge against sleeve 20 and clamp the sleeve against a post 12.

The collar parts 16*a*', 16*b*' formed from shaped sheets 68, 69 are configured to fit together so the projections 52 on one part fit in the recesses 54 of the other part and form an interlocking structure having a frusto-conical shape to wedge sleeve 20 against post 12 during use. The length of end 57 on one collar part 16*a*', 16*b*' and the end 59 on the other collar part 16*b*', 16*a*' combine to encircle the sleeve 20 and post 12 and define two different diameters so the resulting collar parts 16*a*', 16*b*', when mated together, form a frusto-conical structure. The length of the ends 57 on the shaped sheets 68, 59 (FIGS. 22, 23) are not equal, and the length of ends 59 on shaped sheets 68, 69 are not equal—as the sheets are curved and the ends 64, 66 (FIG. 20) are of different length. The length of adjoining ends 57, 59 on the two shaped blanks 68, 69 are of lengths selected to define two different circumferences of that frusto-conical structure.

The collar parts are formed for use with posts 12 having a centerline 70 with a wedging sleeve 20 located between the collar parts 16*a*', 16*b*' and the post to position shelves along the centerline of the post. The sleeve 20 has an inner surface conforming to the shape of the post and an outer surface with a wedge-shape that is closer to the centerline at the top of the sleeve than at the bottom of the sleeve. The method of manufacturing one of the collar parts includes the preferable, but optional step of forming a first planar blank 68 having first and second opposing ends 64, 66, respectively, joined by first and second opposing sides 62*a*, 62*b* respectively. The first planar blank 68 is formed with a slight fan shape with the first and second ends being convexly curved like the top and bottom of a fan and the second end longer than the first end. The forming step forms the first and second sides inclined relative to centerline 70 that bisects the first and second ends 64, 66, respectively.

The manufacturing method also includes forming a shaped blank 68 from the first planar blank. The shaped blank is formed to have a projection with an outer side 56 that extends in a direction from the longer blank end 66 toward the second end 64 (FIG. 20) and along each of the first and second sides 62*a*, 62*b*. Each projection 52 is formed with an outer edge 56 formed by a portion of a first or second side 62*a*, 62*b*. Each projection 52 is formed having a distal end located before and spaced apart from the second end 66 and each projection is located adjacent to a recess 54 formed in the blank 68, the recess 54 having the same shape as the projection 52 and extending along the length of the projection and located inward of the projection toward the centerline 70. Each recess 54 has a straight side 58 extending to the second end 66 to form a shortened second end 66 having a length less than that of the first blank end 64. The shaped blank is also formed with a slot having closed end 40 and opposing sides 42 that extends along the centerline in the same direction as the recesses 54. The length of the sides 42 of the slot and the location of the end 40 of the slot are selected so the end 40 preferably abuts the ends of support tabs 30 during use and preferably rest against those support tabs. The spacing between sides 42 is selected so the sides abut the sides of support tables 30 during use and preferably clamp them together.

The manufacturing method also includes the step of bending the shaped blank 68 about the centerline 70 to form a tapered, frusto-conical shape having a smaller radius of curvature at the first end 59, and a larger radius of curvature at the second end 57, so that the projections 52 extend toward the end with the larger radius of curvature, which is end 57 in FIG. 22. The resulting collar part is as shown as collar part 16*a*' as shown in FIG. 10*a*, 11*a*-11*c*.-13 and part 16*b*' in FIG. 10*b*.

The manufacturing method also involves forming a second shaped blank 69 from the first planar blank 60. The shaped blank 69 is formed having a projection 52 with an outer 56 side that extends in a direction from the longer blank end 66 (FIG. 20) or collar end 59, toward the sorter blank end 64 and along each of the first and second sides 62*a*, 62*b*. Each projection 52 has an outer edge 56 formed by a portion of a first or second side 62*a*, 62*b*. Each projection 52 is formed to have a distal end located before and spaced apart from the longer blank end 66 (FIG. 20) or end 59. Each projection 52 is located outward of and adjacent to a recess 54 formed in the blank 59. The recess 54 is preferably formed to have the same shape as the projection 52 with the recess extending along the length of the projection and located inward of the projection. Each recess 52 has a straight side 58 extending to the blank end 64 to form a shortened first end 57 having a length less than that of the second end 66. The shaped blank 69 is also formed with a slot having closed end 40 and opposing sides 42 that extends along the centerline in the same direction as the recesses 54. The length of the sides 42 of the slot and the location of the end 40 of the slot are selected so the end 40 preferably abuts the ends of support tabs 30 during use and preferably rest against those support tabs. The spacing between sides 42 is selected so the sides abut the sides of support tables 30 during use and preferably clamp them together.

The shaped blank 69 is bent about the centerline to form a tapered, frusto-conical shape having a smaller radius of curvature at the second end 57 and a larger radius of curvature at the first end 59 so that the projections 52 extend toward the end with the smaller radius of curvature, here end 57. The shaped blank 59 is thus cut and bent into the shape of collar part 16*b*' as shown in FIGS. 10*a* and 12*a*-12*b* with projections 52 extending upward during use toward a smaller diameter end of the collar.

The shaped blank 21 may be bent about the centerline 70 in the same manner described above to form collar parts 16*a*, 16*b* of FIGS. 1-9. The collar parts 16*a*, 16*b*, 16*a*', 16*b*' are preferably formed of metal, but may be formed of suitable plastics, preferably injection molded to the desired shape. The metal parts are typically stronger and thus preferable.

Referring to FIGS. 23-26, the sleeve halves 20*a*, 20*b* may be joined together by one or more, but preferably less than three, hinges 80. The hinge 80 is preferably a flexible hinge that repeatably flexes with ease rather than a pinned hinge with multiple, inter-locking segments that rotate a hinge pin. The hinges 80 are preferably connected to the support tabs 30 and/or retaining flanges 32. In the depicted embodiment two hinges 80 are used to join two adjacent support tabs 30*a*, 30*b* that abut each other or face each other during use. Thus, each of the two hinges 80 has a first end connected to support tab 30*a* of sleeve half 20*a* and has a second end connected to support tab 30*b* of sleeve half 20*b*. The depicted hinges 80 are preferably made of a flexible material to allow the sleeve halves 20*a*, 20*b* to repeatedly open and close around post 12.

Advantageously, the hinges 80 are made of plastic and of the same material as the sleeve halves 20*a*, 20*b*, with the hinges 80 being integrally formed with the sleeve halves 20*a*, 20*b* by injection molding to form a unitary part of the same material. The hinges 80 are shown with a rectangular cross-section with the long axis of the rectangle generally parallel with axis 18 during use. The hinges are advantageously parallel to the abutting faces of the supports 30*a*, 30*b* to which the hinges connect so that the hinges bend along a line parallel to the abutting faces of the supports 30 and allow the sleeve halves 20*a*, 20*b* to rotate about an axis parallel to those abutting faces of support tabs 30*a*, 30*b*.

Since the support tabs 30*a*, 30*b* face each other and preferably abut each other during use with the locking tabs 34 engaging the locking recesses 36, the hinges 80 flex sufficiently to allow that configuration, contact and locking engagement. Each support tab 30*a*, 30*b* preferably has a recess 82 in the exterior side of the support tab 30 at the location where each hinge 80 connects to each support tab. Advantageously, the recess 82 extends completely around the hinge 80 so as to completely encircle or completely surround the juncture of the hinge with the support tab 30. The recess 82 has a uniform depth so the hinge 80 extends from the surface of the recess 82. The depth of the recess 82 between the hinge 80 and the abutting face of support tab 30 allows the hinge to fit into the recess and reduces the deformation of the hinge. Preferably, the hinge has a thickness "t" in its thin dimension and the recess 82 has a depth of about 0.5 t to t, so that the hinge can lay flat in the recess when the sleeve halves 20*a*, 20*b* join to form sleeve 20, or at least lay flat at the face of the abutting support tabs 30*a*, 30*b*. The depth of recess 82 is preferably selected so that the thickness of the hinge 80 does not prevent the faces of the support tabs 30*a*, 30*b* from abutting. By having the recess 82 surround or encircle the hinge 80, the hinge 80 bends uniformly in opposing directions along the axis about which the hinge 80 flexes during use and that is believed to reduce stress on the hinge as it bends.

The recess 82 is configured to allow the hinge 80 to fit within the recess, preferably so the hinge does not extend beyond the adjacent outer surface 24 of the sleeve 20 when the sleeve halves 20*a*, 20*b* are interlocked by locking tabs 34. As described above, a locking collar 16 with an inner surface conforming to the frusto-conical (or other) tapered shape of the outside of the sleeve 20 and if the hinge 80 extends about the outer surface of the sleeve then hinge cold impede a tight fit of the sleeve and collar. Thus, the hinge 80 fits within the recess 82 so the outer surface of the hinge 80 does not extend above the outer surface of the sleeve 20 defined by the other sleeve parts. A slight extension of about one mm or less may be workable if the sleeve 20 is made of a deformable plastic or polymer material, but that is not desired. Thus, the hinge 80 fits within the recess 82 so the outer surface of the hinge 80 is at about the same surface as that of the remaining portions of the sleeve 20 when the sleeve is on the post 12. By using a recess 82 in each support tab 30*a*, 30*b* to receive the hinge 80 when the sleeve halves 20*a*, 20*b* are interlocked the outer surface of the hinge is at or preferably slightly below the outer surface 24 of the sleeve 20 and sleeve parts 20*a*, 20*b* when the parts are interlocked for use. Thus, the hinge 80 does not prevent the collar 16 from fitting snuggly over the sleeve 20. Because the inside of the collar is configured to mate closely with the outside of the sleeve, a protruding hinge 80 could interfere with the mating of the collar and sleeve, or the collar will deform the hinge and damage or destroy the hinge's function. A slight protrusion at the location of the hinge can be tolerated if the hinge material is sufficiently deformable as to allow the hinge to open and close at least a few times after being deformed and hold the parts together, and this slight protrusion is encompassed within the meaning of having the outer surface of the hinge at or adjacent to the surface of the sleeve or sleeve parts joined by the hinge. This slight protrusion is also within the meaning of having a hinge with an outer at adjacent to the outer surface located at the surface of the first and second tabs that are hinged, adjacent the location of the hinge.

Figure 24:
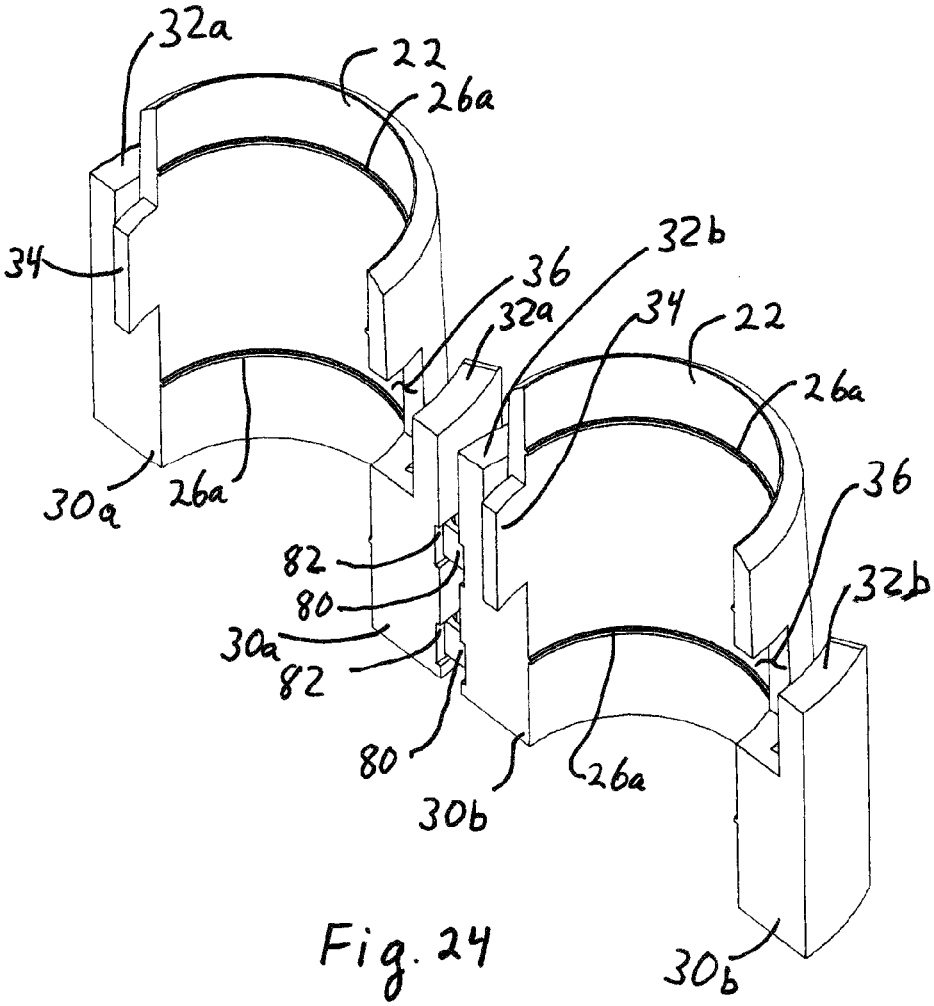
FIG. 24 is a perspective view of the sleeve of FIGS. 2-4 with the sleeve parts hinged together.

As best seen in FIGS. 24-25, the hinge 80 connects to each support tab 30*a*, 30*b* at a location spaced slightly inward from the abutting face of the support tab 30 to which the hinge is joined. The hinge line along which the hinge 80 and connected support tabs 30*a*, 30*b* rotate is preferably at about the outer surface 24 of the support tabs 30 or advantageously within 1-3 mm of that outer surface. A connection at or outward of the outer surface 24 of the sleeve halves 20*a*, 20*b* is believed suitable, but less preferred. An offset of about 1-5 mm from the abutting face of support tab 30 to the centerline of the hinge 80 is believed suitable with an offset of about 2-3 mm being preferred. A hinge thickness of about 1-3 mm is believed suitable and a hinge length of about 2-8 mm is believed suitable, with a length of about 2-3 mm being preferred. A shorter length on the hinge 80 makes the hinge stiffer and the stiffness has the advantage of resiliently urging the sleeve halves 20*a*, 20*b* into an open position when the latches 34 are not engaged with the latching recesses 36 and that is believed desirable. But a shorter length of the hinge 80 also increases stress as the hinge bends to allow the sleeve halves 20*a*, 20*b* to engage and form sleeve 20 engaging the post 12 during use. The dimensions of the preferably rectangular cross-section of the hinge 80 also affect the stiffness, flexibility and stress of the hinge. Hinge dimensions providing a suitable compromise of flexibility, opening force and stress can be determined given the present disclosure.

The hinge(s) 82 have the advantage of avoiding losing one of the sleeve halves 20*a*, 20*b* during shipping or use. The hinge(s) 82 also connect mating parts and avoid potential confusion in matching sleeves halves 20*a*, 20*b* during assembly and use. By forming the hinge(s) 80 during formation of the sleeve halves 20*a*, 20*b* a unitary part can be formed of a single piece of material and that ensure material uniformity, strength and performance. The unitary structure also simplifies sorting the parts for shipment, simplifies assembly and simplifies use.

Because the hinge 80 is preferably located in and surrounded by recess 82 the hinge or hinges are preferably located in the support tabs 30*a*, 30*b*. But the hinges could be located in the retaining flange 32, using the same construction described above. If a hinge 80 is connected to the retaining flange 32 the recess 82 may reduce the strength of the flange 32 and increase its flexibility. Depending on the strength and flexibility needed for a particular retaining flange the recess 82 may not affect performance and suitable design can be achieved if a recess 82 is desired to be used. Alternatively, because the recess 82 is optional, the hinge 80 could connect the sleeve halves 20*a*, 20*b* without a recess, with the hinge location and length being varied to achieve a desired connection of the parts to which the hinge is connected, but with an outer surface of the hinge forming a substantially continuous surface with and not protruding above the outer surface the support tabs 30 or flanges 32 connected to the hinge(s).

Because the hinge 80 connects mating parts the assembly of a shelving unit is simplified and users will not attempt to mate two like sleeve parts such as mating sleeve half 20*a* with 20*a*, or sleeve half 20*b* and 20*b*. Also, because the mating parts are connected by the hinge 80 parts will not become separated during shipment, assembly or disassembly. Because the hinge line at the surface or slightly recessed or at least does not extend much beyond the outer surface 24 of the sleeve 20, the mating between the collar 16 and sleeve 20 is not disrupted by the hinge 80.

Referring to FIGS. 28-35, a further embodiment of a sleeve and collar are shown with resulting modifications to the end frames and shelves. The depicted sleeve portions 20*a*, 20*b* have two opposing sides, each having one of the first and second retaining flanges 32*a*, 32*b* extending along a the side. A third retaining flange 32*c* is located between the flanges 32*a*, 32*b* on each sleeve portion 20*a*, 20*b*. The third retaining flange 32*c* is preferably located equally between the side retaining flanges 32*a*, 32*b*. The third retaining flange 32*c* is constructed like that of retaining flanges 32*a*, 32*b* as the retaining flange 32*c* is offset from the adjacent exterior surface of the sleeve portion by a support tab 30*c* with a lip 33 between the base of the retaining flange 32*c* and the adjacent portion of the sleeve. The remaining portions of the sleeve are the same and the description is not repeated.

Figure 30A:
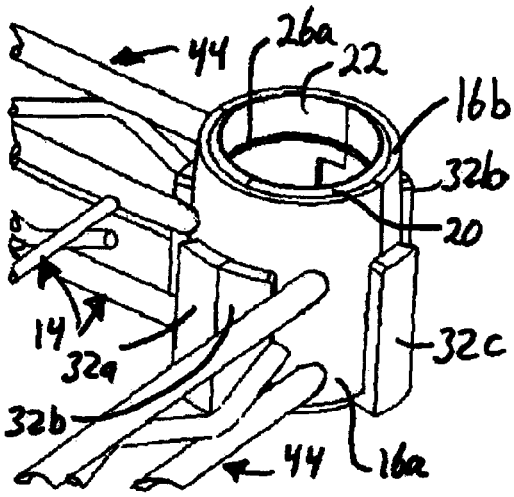
FIG. 30*a* is an upper left perspective view of the corner of FIG. 29.
Figure 31A:
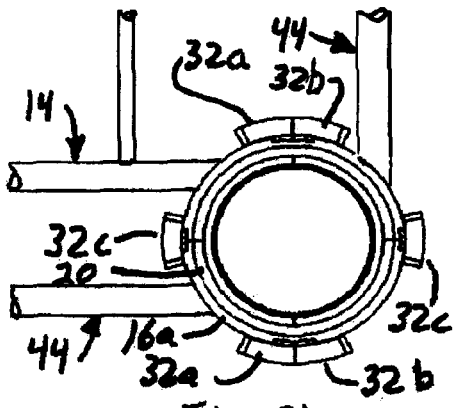
FIG. 31*a* is a top plan view of the corner of FIG. 29.
Figure 30B:
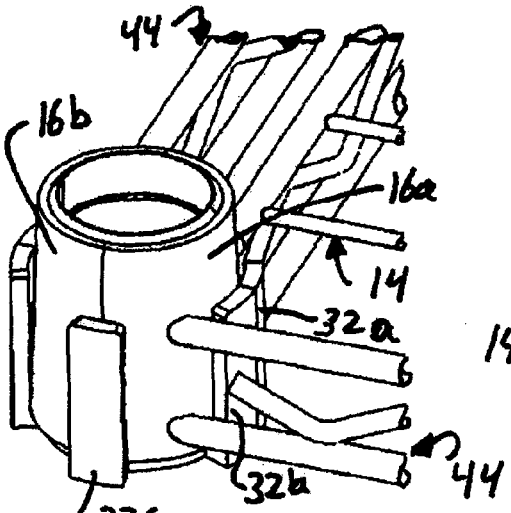
FIG. 30*b* is an upper right perspective view of the corner of FIG. 29.
Figure 31B:
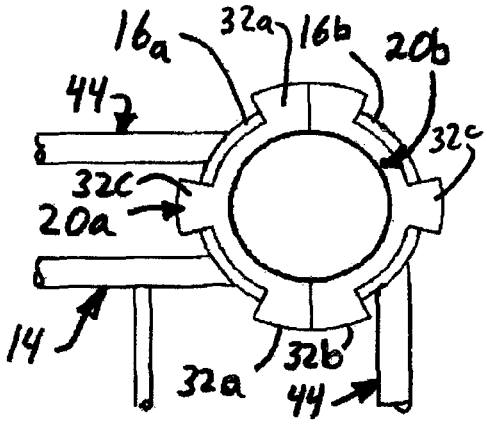
FIG. 31*b* is a bottom plan view of the corner of FIG. 31*a;*
Figure 32:
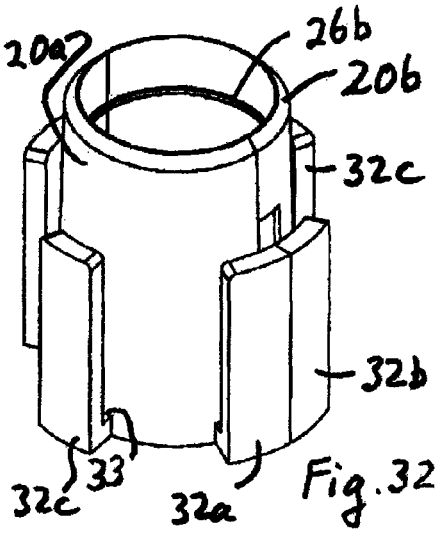
FIG. 32 is a perspective view of the further embodiment of the sleeve of FIG. 28.
Figure 33C:
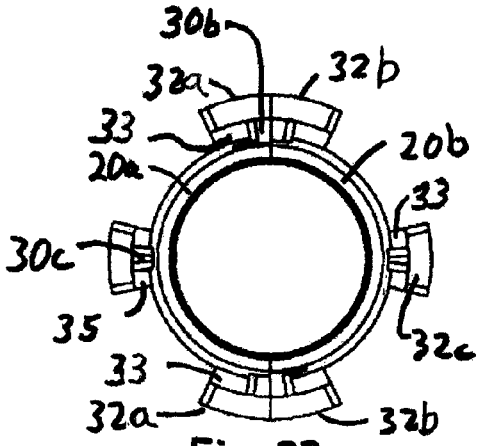
FIG. 33*c* is a top plan view of the sleeve of FIG. 33*a;*
Figure 33B:
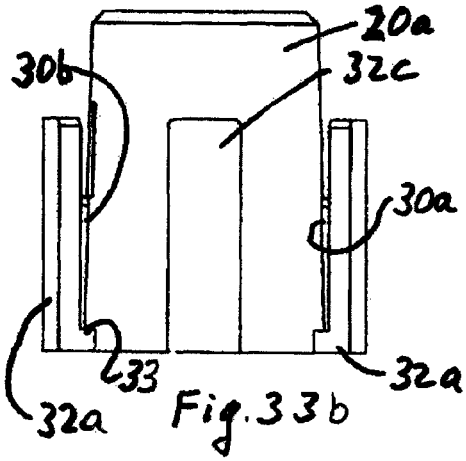
FIG. 33*b* is a left side plan view of the sleeve of FIG. 33*a*, with the opposing side view being a mirror image thereof.
Figure 33A:
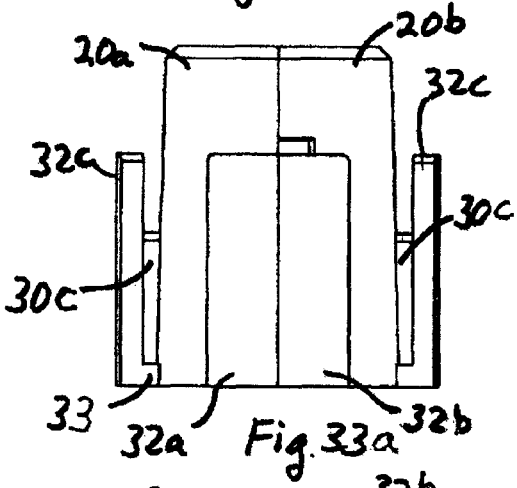
FIG. 33*a* is a front plan view of the sleeve of FIG. 32.
Figure 33D:
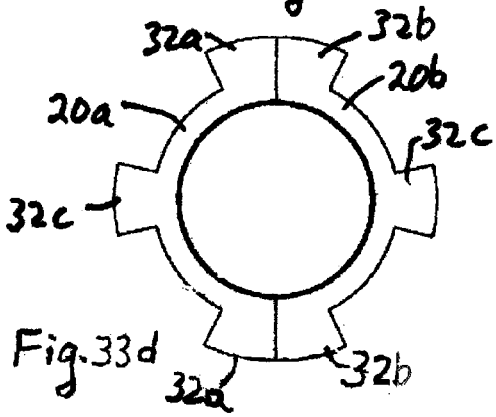
FIG. 33*d* is a bottom plan view of the sleeve of FIG. 33*a;*
Figure 34D:
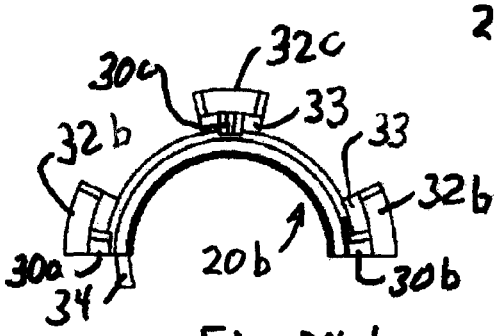
FIG. 34*d* is a top plan view of the half sleeve of FIG. 34*b;*
Figure 34A:
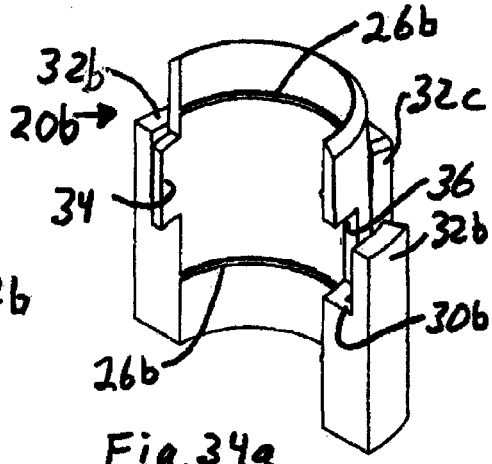
FIG. 34*a* is an upper perspective view of one half of the sleeve of FIG. 32.
Figure 34B:
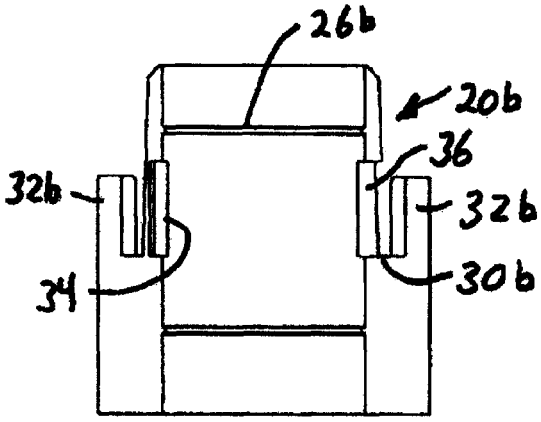
FIG. 34*b* is a front plan view of the half sleeve of FIG. 34*a;*
Figure 34C:
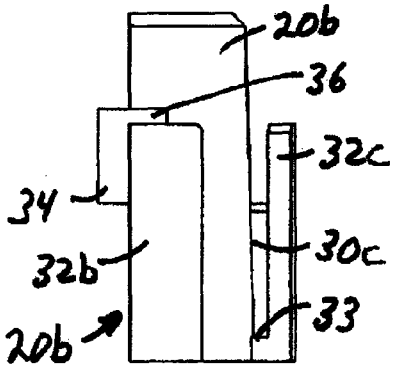
FIG. 34*c* is a right side plan view of the half sleeve of FIG. 34*b* with the opposing side view being a mirror image thereof.
Figure 34E:
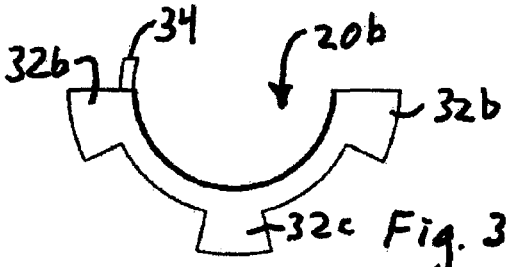
FIG. 34*e* is a bottom plan view of the half sleeve of FIG. 34*b;*
Figure 35D:
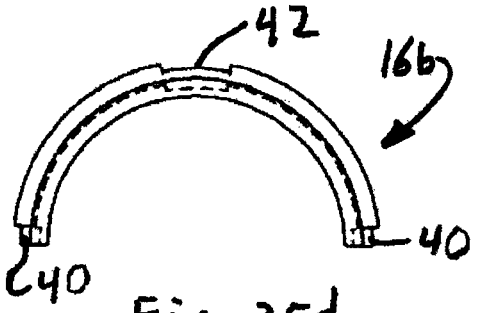
FIG. 35*d* is a top plan view of the collar portion of FIG. 35*b*.
Figure 35A:
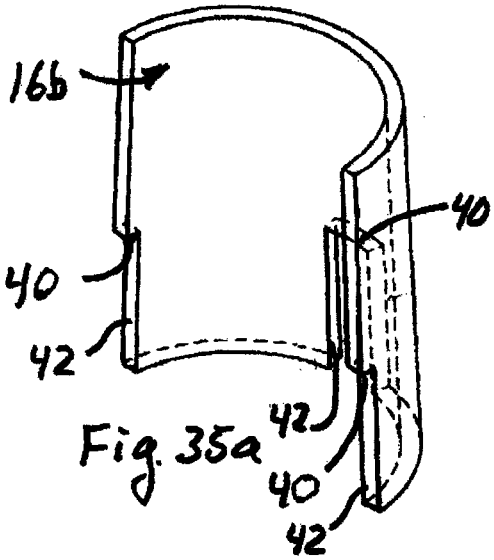
FIG. 35*a* is an upper perspective view of a collar portion of FIG. 29 with no shelving portions or connector portions attached thereto.
Figure 35B:
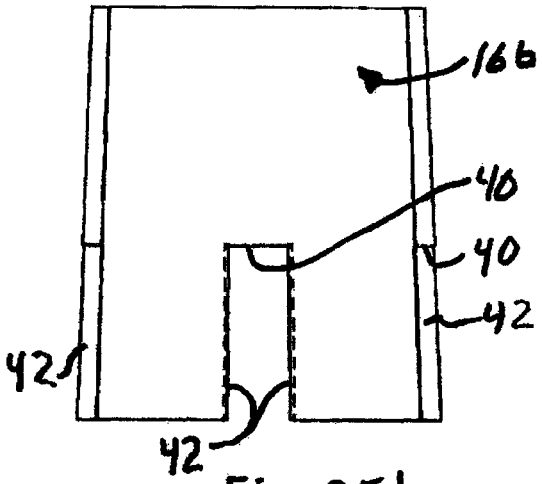
FIG. 35*b* is a front plan view of the collar portion of FIG. 35*a;*
Figure 35C:
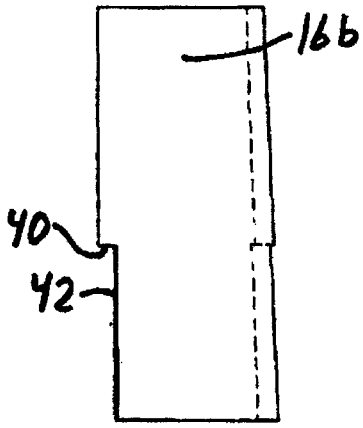
FIG. 35*c* is a right side plan view of the collar portion of FIG. 35*b*, with the opposing side being a mirror image thereof.
Figure 35E:
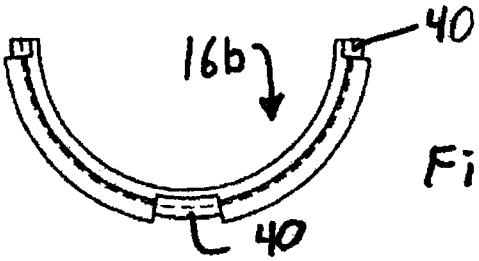
FIG. 35*e* is a bottom plan view of the collar portion of FIG. 35*b*.

The mating collar portions 16*a*, 16*b* have the horizontal or lateral arms of the shelf 14 connect to collar portions 16*a* at two locations which are at right angles to each other for a rectangular shelf (FIGS. 30-31). The collar portions 16*a*, 16*b* have opposing sides each forming half of an additional slot, as best seen in FIGS. 35*a*, 35*b*. Thus, slot sides 42 extend along the lower portion of each of the two opposing, generally vertical sides of each collar portion 36*a*, 16*b*, with partial (about half) of a slot end 40. The collar portions 16*a*, 16*b* are slightly inclined so they form a slightly inclined cone when joined or mated together.

As best seen in FIGS. 28-31, in use the central slot having opposing sides 42 and end 40 fits over the two abutting end flanges 30*a*, 30*b* while the half slot formed by the slot sides 42 along opposing sides of each collar portion fit between the third retaining flange 32*c* and the adjacent surface of the sleeve 20*a* or 20*b*, with the partial slot end 40 abutting the top of support tab 30*c*. The two added support tabs 30*c* contacting the partial slot ends 40 are believed to provide additional strength so the sleeve and collar assembly can allow the connected shelf 14 to carry more weight. The collar portions 16*a*, 16*b* may be connected to the sleeve portions 20*a*, 20*b* separately, or the collar portions 16*a*, 16*b* may be connected to opposing ends of end frame 44. Thus, at least one (and preferably both) of the first and second interlocking sleeve parts 20*a*, 20*b* have a third outwardly extending support tab 30*c* extending outward from between the first and second support tabs 30*a*, 30*b* and from between the retaining flanges 32*a*, 32*b* of the at least one interlocking sleeve parts. A third retaining flange 32*c* is connected to the third support tab 30*c* and located so a portion of at least one and preferably both collar parts 16*a* and 16*b* fits snugly between the third retaining flange and the at least one interlocking part of the sleeve and further contacts the third support tab 30*c* associated therewith.

Figure 26:
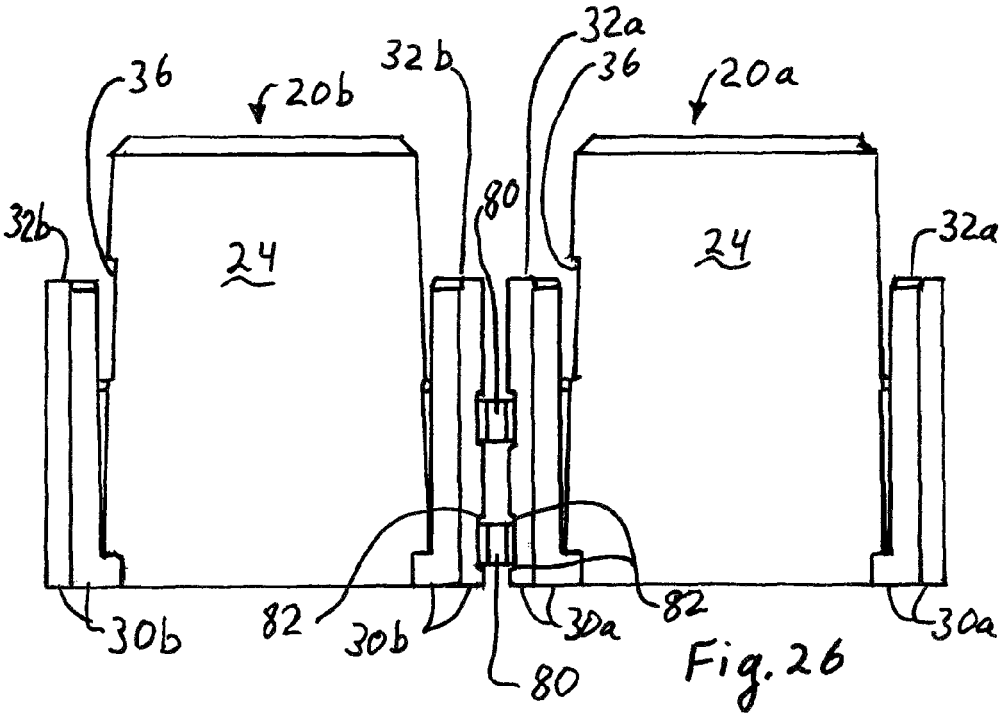
FIG. 26 is a back plan view of the sleeve of FIGS. 24 and 26.
Figure 36A:
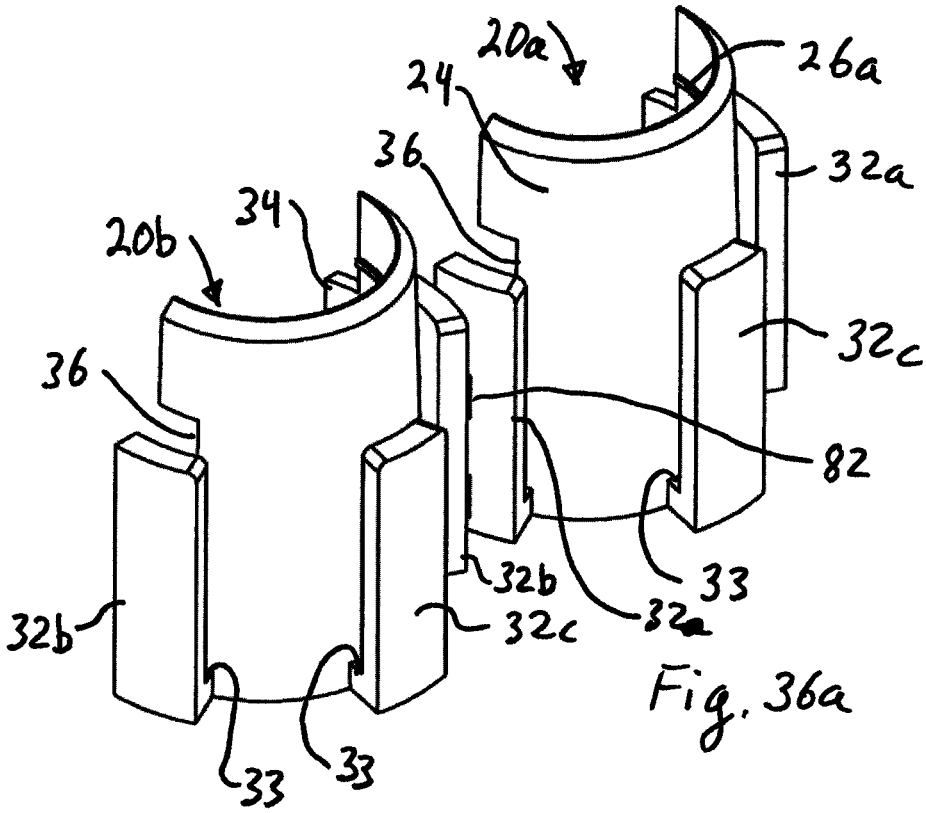
FIGS. 36*a* and *b* are perspective views of opposing sides of the sleeve of FIGS. 32-34 with the two sleeve parts hinged together.
Figure 36B:
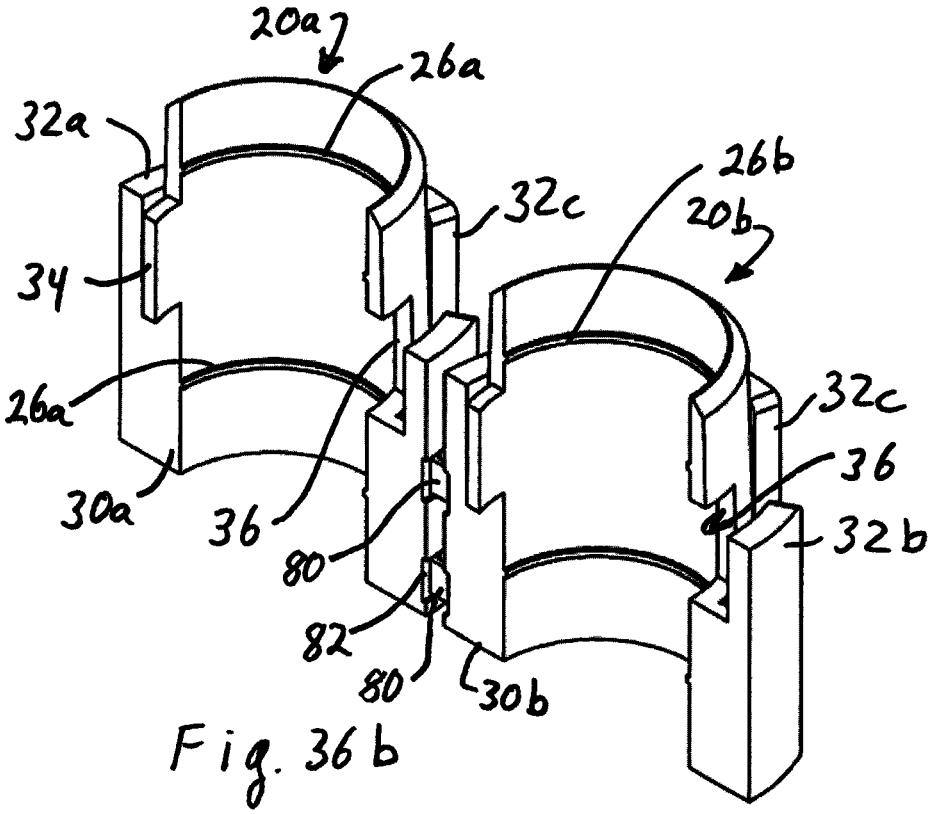

Given the present disclosure, it is apparent that this third retaining flange on the sleeve portions and partial slot on the collar portions may be applied to the hinged sleeve portions of FIGS. 25-26 as well as being applied to the interlocking collar parts of FIGS. 10-19. A hinged embodiment with hinges 80 connecting the sleeve portions 20*a*, 20*b* having third retaining flange 32*c* is shown in FIGS. 36*a*, 36*b*. As the parts of this hinged embodiment are as previously described in the non-hinged and hinged variations, a further detailed description of those same parts is not repeated. Likewise, the partial slots with partial sides 42 and partial ends 44 on the opposing sides of the collar parts may be formed on the blanks of FIGS. 20-23 by notching the opposing side edges before forming the generally planar part into the conical shape and a detailed repetition of that description is not provided.

The above description is given by way of example, and not limitation. Given the above disclosure, one skilled in the art could devise variations that are within the scope and spirit of the invention. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

What is claimed is:

1. A sleeve for use with a shelving connector having a collar part configured to encircle a portion of a post having an outer surface with grooves at regular intervals along a length of the post, the collar part connected to a shelf, the collar part having a frusto-conical inner surface configured to wedge the sleeve against the post during use in order to position the sleeve, collar part and shelf along a length of the post, comprising:

a sleeve having first and second interlocking parts which when interlocked form:

(a) an inner surface defining a central cylindrical passage extending along a longitudinal axis of the sleeve and configured to conform to and abut the outer surface of the post, the inner surface having at least one rib extending from the inner surface located and configured to mate with a groove in the post; and (b) an outer surface having a generally frusto-conical shape;

each first and second interlocking sleeve part having first and second outwardly extending support tabs each extending outward from a different one of two opposing sides of the sleeve part with first and second retaining flanges extending from the respective first and second support tabs and extending along but offset from the outer surface of the sleeve, the offset being sufficient to allow a portion of the collar part to fit snugly between the first or second retaining flange and abut the support tab associated therewith; and a locking tab extending from one of the first and second sides and a recess formed in the other of the first and second sides with the recess configured to receive the locking tab and prevent relative movement of the first and second sleeve parts along the longitudinal axis.

2. The sleeve as defined in claim 1, wherein one of the first and second support tabs or their respective retaining sleeves are joined by at least one recessed hinge, the hinge being recessed sufficiently so that an outer surface of the hinge does not extend beyond an outer surface of the hinged support tabs or their respective retaining sleeves when the first and second interlocking sleeve parts are joined together.

3. The sleeve as defined in claim 1, wherein each of the two opposing sides of each sleeve is straight and generally aligned with the longitudinal axis, with each retaining flange extending from a different one of the straight sides.

4. The sleeve as defined in claim 1, wherein the extending support tabs extend radially outward from a bottom portion of the sleeve and further comprising a lip extending between the bottom portion of the sleeve to the bottom retaining flange.

5. The sleeve as defined in claim 1, wherein a lower end of the locking tab is adjacent the upper end of the support tab.

6. The sleeve as defined in claim 1, wherein at least one of the first and second interlocking sleeve parts further comprising a third outwardly extending support tab extending outward from between the first and second support tab of the at least one interlocking part, with a third retaining flange connected to the third support tab and located so a portion of the collar part fits snugly between the third retaining flange and the at least one interlocking sleeve part and contacts the third support tab associated therewith.

7. The sleeve of claim 1, wherein one of the first and second support tabs abut during use and are connected by a hinge which does not extend beyond the surface of the first and second tabs that are hinged, adjacent the location of the hinge.

8. A connector assembly for use with a post having a cylindrical cross-section of diameter D and a plurality of grooves at predetermined intervals and a wedging inner sleeve and outer collar part to position a shelf along a longitudinal axis of the post, the connector comprising:

a sleeve having a frusto-conical outer surface with a first, small sleeve end and a second, larger sleeve end with both ends encircling the longitudinal axis during use, the sleeve having a cylindrical interior passage sized to fit around the post during use and having at least one inwardly extending rib configured to fit within one of the grooves of the post during use, the sleeve formed of first and second interlocking sleeve halves each having a smaller top and a larger bottom joined by two opposing sides, each sleeve half including:

a locking tab extending from one side and a recess in the other side configured to receive the locking tab from the other sleeve half;

first and second support tabs extending radially outward from each side at a bottom portion of the sleeve, each support tab having a retaining flange extending therefrom along but offset from the adjacent outer surface of the sleeve half in the direction of the top of the sleeve half, the support tab being configured so that one support tab of each sleeve is located adjacent the corresponding support tab of the other sleeve when the locking tab engages the locking recess to form first and second pairs of support tabs;

at least one first collar part connected to the shelf, the first collar part having an interior surface forming about half of a frusto-conical shape and sized to fit over and mate with the outer frusto-conical surface of the sleeve, the first collar part having a first slot therein located to fit over the first pair of adjacent support tabs and restrain them from moving apart during use, a portion of the collar part adjacent the first slot configured to fit into the offset between the retaining flange and the adjacent part of the sleeve as the first slot fits over the first pair of adjacent support tabs during use, the first collar part having two opposing distal ends extending along an axis generally parallel to the longitudinal axis during use.

9. The connector assembly of claim 8, wherein the first slot in the first collar part and the first pair of adjacent support tabs is configured so the support tabs are urged toward each other by the collar.

10. The connector assembly of claim 8, further comprising a lip extending around at least a portion of a bottom periphery of each sleeve half, the lip extending between the bottom portion of each sleeve half and a bottom portion of the retaining flange to join the sleeve to the bottom of the retaining flange.

11. The connector assembly of claim 8, further comprising at least one second collar part having an interior surface forming about half of a frusto-conical shape and sized to fit over and mate with the outer frusto-conical surface of the sleeve, the second collar part having a second slot therein located to fit over the second pair of adjacent support tabs and restrain them from moving apart during use, a portion of the second collar part adjacent the second slot configured to fit into the offset between the retaining flange and the adjacent part of the sleeve as the second slot fits over the second pair of adjacent support tabs during use.

12. The connector assembly of claim 8, wherein the shelf is connected to the first collar part in a plane generally orthogonal to the longitudinal axis and the end of the slot in the first collar part abuts against the support tab during use.

13. The connector assembly of claim 11, wherein the slot in each collar part extends in a first direction toward the end of the slot; and wherein the first collar part has two first projections each extending along at least a portion of a different distal end of the first collar part on opposing sides of the slot in the first collar part and extending in the first direction, the first collar part having a first recess located inward of and adjacent to each first projection and further located on opposing sides of the slot and extending in a direction opposite the first direction; and wherein the second collar part has two second projections each extending along at least a portion of a different end of the second collar part on opposing sides of the slot in the second collar part and extending in a direction opposite the first direction, the second collar part having a second recess located inward of and adjacent to each second projection and further located on opposing sides of the slot in the second collar part and extending in the first direction such that the during use the first projections fit within the second recesses and the second projections fit within the first recesses to interlock the first and second collar parts and prevent relative motion of the sleeve parts along the longitudinal axis.

14. The connector assembly of claim 11, wherein a hinge connects the first and second abutting support tabs, the hinge being located in a recess formed in the first and second abutting support tabs during use to help avoid an outer surface of the hinge from preventing positioning of the collar when the collar is on the sleeve.

15. The connector assembly of claim 11, wherein at least one of the first and second slots has sides that abut against the respective first and second support tabs during use.

16. The connector assembly of claim 11, wherein the first and second slots extend in a first direction toward the end of the slot; and wherein the first collar part has two opposing distal ends and two first projections each extending along at least a portion of a different one of the distal ends, the first projections extending in the first direction, the first collar part having a first recess located inward of and adjacent to each first projection and further located on opposing sides of the slot and extending in a direction opposite the first direction; and wherein the second collar part has two opposing distal ends and two second projections each extending along at least a portion of a different one of the distal ends of the second collar part, the second projections extending in a direction opposite the first direction, the second collar part having a second recess located inward of and adjacent to each second projection and further located on opposing sides of the slot in the second collar part and extending in the first direction such that the during use the first projections fit within the second recesses and the second projections fit within the first recesses to interlock the first and second collar parts.

17. The connector assembly of claim 8, wherein one of the first and second support tabs abut during use and are connected by a hinge which does not extend beyond the surface of the first and second tabs that are hinged, adjacent the location of the hinge.

18. The connector assembly of claim 8 wherein each sleeve half includes a third outwardly extending support tab extending outward from between the first and second support tabs and a third retaining flange connected to the third support tab and located so a portion of the first collar part fits snugly between the third retaining flange and contacts the third support tab associated with that third retaining flange.

19. The connector assembly of claim 18, wherein the sleeve halves are joined by at least one hinge, the hinge connecting to each of the support tabs in a recess that contains the hinge during use so that an outer surface of the hinge does not extend beyond the adjacent surface of the hinged parts when the first and second interlocking halves are joined together.

20. A kit for a shelving unit having at least two, generally horizontal shelves connected to at least three generally vertical posts, the kit comprising:

at least three posts each having a longitudinal axis and a cylindrical cross-section along the portion of a length of the posts at which the shelves are to be connected, each post having a plurality of grooves therein at predetermined locations which grooves are orthogonal to the longitudinal axis;

at least six sleeves each having a cylindrical interior surface with at least one inwardly extending rib, the cylindrical surface configured to abut the post and encircle the longitudinal axis during use with the rib configured and located to fit in one of the grooves in the post during use, each sleeve having a frusto-conical exterior surface, each sleeve further having first and second support tabs extending radially outward from a bottom portion of opposing sides of each sleeve a short distance, each first and second support tab having an upwardly extending retaining flange extending along an exterior surface of the sleeve and offset therefrom by the support tab from which the retaining flange extends;

at least two shelves, each shelf having at least three first-collar parts located around a periphery of the shelf and facing outward from the shelf, each first-collar part having a frusto-conical interior surface smaller at the top and wider at the bottom and extending around an arc of about 180° along a first-collar part axis which coincides with the longitudinal axis during use, each first-collar part having a first slot therein extending parallel to the first-collar part axis, each first slot having a closed end and two opposing sides opening onto a bottom of the first-collar part in which the first slot is located, each first-collar part and its first slot sized so the first-collar part fits between one of the retaining flanges and exterior surface of the sleeve while the sides of the first slot fit on opposing sides of one of the first support tabs from which the retaining flange extends, with the first slot and first support tab configured so that the first slot fits snuggly over the first support tab;

at least six second-collar parts each having a frusto-conical interior surface that is smaller at the top and wider at the bottom and extending around an arc of about 180° along the first-collar part axis which coincides with the longitudinal axis during use, each second -collar part having a second slot therein with a closed end and two opposing sides opening onto a bottom of the second-collar part in which the second slot is located with the second slot extending parallel to the first-collar part axis during use, the first-collar part and second-collar parts interlocking to define a generally cylindrical interior passage, each second-collar part and its second slot sized so the second-collar part fits between one of the retaining flanges and exterior surface of the sleeve from which the retaining flange extends while the sides of the second slot fit on opposing sides of the second support tab from which the retaining flange extends, with the second slot and second support tab configured so that the second slot fits snuggly over the second support tab.

21. The kit of claim 20, wherein each sleeve comprises a split sleeve having two sleeve halves each having a semi-circular top and semi-circular bottom joined by two opposing sides, each sleeve half having a locking tab extending from one of its sides and a recess on the other of its sides which recess is configured to receive the locking tab of the other sleeve half to interlock the two sleeve halves together.

22. The kit of claim 20, wherein each sleeve comprises a split sleeve having two sleeve halves each having a semi-circular top and semi-circular bottom joined by two opposing sides, with about half of a first support tab extending from one side of each sleeve half and about half of a second support tab extending from the other side of each sleeve half, with the first and second slots of the first and second collar parts holding adjacent halves of the first and second support tabs together during use.

23. The kit of claim 21, wherein each of the sleeve halves further includes a locking tab extending from one of its sleeve sides and a recess on the other of its sleeve sides which recess is configured to receive the locking tab of a different sleeve half to interlock the two sleeve halves together and prevent relative movement of the sleeve halves along the longitudinal axis.

24. The kit of claim 21, further comprising a lip extending outward from a bottom edge of a plurality of the sleeve halves with the lip located to abut a first and second collar during use.

25. The kit of claim 21, wherein a plurality of the sleeves comprise a hinge connecting the two sleeve halves, the hinge being located in a recess during use so a top of the hinge is at the surface of the first and second tabs that are hinged, adjacent the location of the hinge.

26. The kit of claim 21, wherein the sides of a plurality of the sleeves are straight and generally parallel to the longitudinal axis and wherein a plurality of the sleeves encircle about 180° of the longitudinal axis or less during use.

27. The kit of claim 21, wherein a plurality of the first and second support tabs have a circumferential width W measured in a plane orthogonal to the longitudinal axis when the sleeves encircle that longitudinal axis, and the opposing sides of the first and second slots are spaced apart a corresponding width slightly smaller than W.

28. The kit of claim 20, wherein a plurality of the first and second support tabs have a circumferential width W measured in a plane orthogonal to the longitudinal axis when the sleeves encircle that longitudinal axis, with the circumferential width W increasing from the closed end of the slot to the open end of the slot and the width of the first and second slots increases in a corresponding manner so the slots straddle the support tabs during use and wedge the support tabs together during use.

29. The kit of claim 20, wherein two support tabs that abut during use are connected by a recessed hinge located at the outer surface of the support tabs connected by the hinge.

* * * * *